US010400708B2

(12) United States Patent
Mahkamov et al.

(10) Patent No.: US 10,400,708 B2
(45) Date of Patent: Sep. 3, 2019

(54) ROTARY STIRLING-CYCLE APPARATUS AND METHOD THEREOF

(71) Applicant: University of Northumbria, Tyne And Wear (GB)

(72) Inventors: Khamidulla Mahkamov, Durham (GB); Irina Makhkamova, Durham (GB)

(73) Assignee: University of Northumbria, Tyne and Wear (GB)

( * ) Notice: Subject to any disclaimer, the term of this patent is extended or adjusted under 35 U.S.C. 154(b) by 0 days.

(21) Appl. No.: 16/060,277

(22) PCT Filed: Nov. 3, 2016

(86) PCT No.: PCT/GB2016/053405

§ 371 (c)(1),
(2) Date: Jun. 7, 2018

(87) PCT Pub. No.: WO2017/098197

PCT Pub. Date: Jun. 15, 2017

(65) Prior Publication Data

US 2018/0372022 A1 Dec. 27, 2018

(30) Foreign Application Priority Data

Dec. 11, 2015 (GB) ..... 1521880.3

(51) Int. Cl.
*F02G 1/044* (2006.01)
*F02G 1/043* (2006.01)
(Continued)

(52) U.S. Cl.
CPC ..... *F02G 1/044* (2013.01); *F02G 1/043* (2013.01); *F02G 1/053* (2013.01); *F02G 3/00* (2013.01);
(Continued)

(58) Field of Classification Search
CPC . F02G 1/044; F02G 1/053; F02G 3/02; F02G 2270/10; F02G 2243/00
See application file for complete search history.

(56) References Cited

U.S. PATENT DOCUMENTS 4,009,573 A 3/1977 Satz
4,103,491 A 8/1978 Ishizaki
(Continued)

FOREIGN PATENT DOCUMENTS

AT 412663 B 5/2005
DE 10123078 C1 5/2002
(Continued)

OTHER PUBLICATIONS

Seifert, Marco, "International Search Report," prepared for PCT/GB2016/053405, dated Feb. 16, 2017, four pages.
(Continued)

*Primary Examiner* — Mark A Laurenzi
*Assistant Examiner* — Shafiq Mian
(74) *Attorney, Agent, or Firm* — Winstead PC

(57) ABSTRACT

A Stirling-cycle apparatus is provided comprising a hermetically sealable housing; a first rotary displacement unit in fluid communication with a second rotary fluid displacement unit, each operably mounted in a separate, fluidly sealed portion within said housing and adapted to provide a cyclic change of at least one thermodynamic state parameter of a working fluid during use. Furthermore, each one of said first and second rotary displacement unit comprises a compressor mechanism, having a first compressor working chamber that is adapted to receive a first portion of said working fluid, and at least a second compressor working chamber that is adapted to receive a second portion of said working fluid, said first compressor working chamber comprises a first outlet port and said second compressor working chamber comprises a second outlet port. Each one of said first and second rotary displacement unit further comprises an expander mechanism, having a first expander working chamber that is adapted to receive said first portion of said
(Continued)

working fluid, and at least a second expander working chamber that is adapted to receive said second portion of said working fluid, said first expander working chamber comprises a first inlet port and said second expander working chamber comprises a second inlet port; a drive coupling assembly, adapted to operably and operatively couple said first expander mechanism to said first compressor mechanism. The drive coupling assembly further comprises a rotating valve mechanism, adapted to provide a predetermined sequence of a cyclic fluid exchange between said first compressor working chamber and said first expander working chamber, and between said second compressor working chamber and said second expander working chamber, at predetermined intervals of the angle of rotation of said first and second rotatory displacement unit. The Stirling-cycle apparatus further comprises an actuator, operably coupled to said first and second rotary displacement unit, and adapted to synchronously link the rotational movement of said first rotary displacement unit with said second rotary displacement unit, such that said first predetermined cyclic change of at least one thermodynamic state parameter of said working fluid is offset in relation to said second predetermined cyclic change of at least one thermodynamic state parameter of said working fluid by a predetermined phase angle, during use.

22 Claims, 19 Drawing Sheets

(51) Int. Cl.

| | |
|---|---|
| ***F02G 1/053*** | (2006.01) |
| ***F02G 3/00*** | (2006.01) |
| ***F02G 3/02*** | (2006.01) |

(52) U.S. Cl.
CPC ..... *F02G 3/02* (2013.01); *F02G 2243/00* (2013.01); *F02G 2270/10* (2013.01)

(56) References Cited

U.S. PATENT DOCUMENTS

| | | | | |
|---|---|---|---|---|
| 9,086,013 | B2 | 7/2015 | Franklin | |
| 2007/0036667 | A1* | 2/2007 | Sterk | F01C 1/077 418/35 |
| 2007/0264147 | A1* | 11/2007 | Gorban | F01C 1/107 418/201.3 |
| 2008/0098751 | A1* | 5/2008 | Terada | F25B 1/04 62/6 |
| 2012/0267898 | A1* | 10/2012 | Mazza | F01K 7/00 290/1 A |
| 2014/0271308 | A1* | 9/2014 | Franklin | F02B 53/00 418/61.3 |

FOREIGN PATENT DOCUMENTS

| | | | | |
|---|---|---|---|---|
| JP | H03286170 | A | 12/1991 | |
| JP | 2014037777 | A | 2/2014 | |
| KR | 20110120092 | A | 11/2011 | |
| WO | WO-01036801 | A2 | 5/2001 | |
| WO | WO-2005078269 | A1 * | 8/2005 | F01C 1/107 |
| WO | WO-2006023872 | A2 | 3/2006 | |

OTHER PUBLICATIONS

Kim, Y., et al., "Noble Stirling Engine Employing Scroll Mechanism," Proceedings of the 11th International Stirling Engine Conference, Sep. 19-21, 2004, pp. 67-75.

* cited by examiner (a)

(b)

(a)

(b)

ROTARY STIRLING-CYCLE APPARATUS AND METHOD THEREOF

The present invention relates generally to the field of Stirling-cycle machines and more specifically to Stirling engines, —coolers or—heat pumps. In particular, the present invention relates to pistonless Stirling-cycle machines utilising rotary expander- and compressor mechanisms.

INTRODUCTION

It is commonly known that the Stirling cycle is a thermodynamic cycle that includes, inter alia, the cyclic compression and expansion of air or other gas (i.e. a working fluid) at different temperatures, such that there is a net conversion of thermal energy to mechanical work. It is also known that the cycle is reversible, which means that, if supplied with mechanical power, the apparatus can function as a heat pump or cooling machine for respective heating or cooling, and even for cryogenic cooling.

More specifically, the Stirling cycle is a closed regenerative cycle utilizing, in general, permanently gaseous working fluid. Here, "closed-cycle" means that the working fluid is permanently contained within the thermodynamic system, and the term "regenerative" refers to the use of an internal heat exchanger, also called a regenerator. The regenerator increases the device's thermal efficiency by recycling internal heat that would otherwise pass through the system irreversibly. The Stirling cycle, like many other thermodynamic cycles, comprises the four main processes of (i) compression, (ii) heat addition, (iii) expansion, and (iv) heat removal. However, in real engines these processes are not discrete, but rather such that they overlap.

An example of a typical Stirling engine 10 with a crank-drive mechanism is shown in FIG. 1. Here, a single gas circuit is made of two cylinders 12, 14 that are connected to each other through channels of three heat exchangers, a heater 16, a regenerator 18 and a cooler 20. The external surface of the heater 16 has an elevated temperature due to exposure to a high temperature environment and its function is to transfer heat into the working fluid inside the engine, whilst the working fluid flows through the channels of the heater 16. The external surface of the cooler 20 is exposed to relatively low temperature environment and its function is to reject heat from the working fluid whilst it flows through the channels of the cooler 20.

A regenerator 18 is introduced between the heater 16 and the cooler 20 to prevent heat losses that would otherwise occur if the heater 16 and cooler 20 were in direct contact. The regenerator 18 in this example comprises a porous medium that is enclosed in a metallic casing. This porous medium is made from a material with a high heat capacity and should ideally have infinite radial- and zero axial thermal conductance. The porous medium can be understood to act as a heat sponge, where heat is transferred to the material of the regenerator and stored when the working fluid flows from the "hot" zone to the "cold" zone. When the working fluid flows in the opposite direction, the stored heat is returned from the regenerator to the working fluid. Thermo-insulation is usually used to separate the porous medium from the walls of its casing in order to further reduce heat losses.

To provide for most of the working fluid to be in the hot zones (i.e. hot cylinder 12 and heater 16) during the heat input phase, and for most of the working fluid to be in the cold zone (i.e. cold cylinder 14 and the cooler 20) during the heat rejection phase, the piston 22 in the hot cylinder 12 is leading the piston 24 of the cold cylinder 14 by usually 90° to 110° (degrees of crankshaft angle) in the displacement, so the volume of the hot cylinder 12 leads the volume of the cold cylinder 14 in its variation by 90° to 120° degrees.

FIG. 2(*a*) shows an example diagram of volume change (variation) in the hot cylinder 12 (dashed line) and in the cold cylinder 14 (solid line).

The two variable volumes (hot and cold) that are connected by a set of heat exchangers (heater 16, regenerator 18 and cooler 20), the variation of volume in the hot space which is leading the variation of volume in the cold space by 90° to 110° (degrees), and the reciprocating flow of the working gas between the variable hot space and cold space through channels of a set of heat exchangers 16, 18, 20, are characterising features of Stirling cycle machines. Typical PV-diagrams for the variable hot or expansion volume (dashed line) and the cold or compression variable volume (solid line) are shown in FIG. 2(*b*).

Therefore, if the heater 16 is exposed to a relatively high temperature environment and the cooler 20 is exposed to a relatively low temperature environment, then the machine works as an engine that exerts power (i.e. the hot or expansion space area is greater than the cold or compression space area in the PV diagram, see FIG. 2(*b*)).

However, if the cooler 20 is exposed to a relatively low temperature environment and the pistons are driven using an electric motor (e.g. via a shaft) or any other actuation sources, then the temperature of the working fluid in the heat exchanger 16 and variable expansion space 12 will reduce significantly (e.g. down to cryogenic levels), so that the machine operates as a cooling device generating cold (i.e. the expansion space area is less than the compressions space area in the PV diagram).

Alternatively, if the heat exchanger 16 is exposed to the relatively low temperature environment and the pistons are driven using an electric motor (e.g. via a shaft) or using any other actuation sources, then the temperature of the heat rejection in the cooler 20 will be significantly higher than the temperature of the heat exchanger 16, and the machine is working as a heat pump (i.e. absorbing heat at low temperature and delivering it ah high temperature).

The cycle of conventional Stirling machines with reciprocating motion of pistons in cylinders is usually completed after 360 degrees of the shaft angle.

However, conventional Stirling machines with reciprocating piston motion in cylinders (kinematical drive engines or free piston reciprocating machines) come with considerable disadvantages, such as, for example:

- Relatively large volumes and large specific areas of the variable volumes in the cylinders, which result in greater weight and dimensions of machines;
- Relatively large volume and weight of a crank-case and complexity of crank-drive or other types of kinematical drive mechanisms;
- Relatively low linear velocities of pistons, resulting in a relatively low rotational speed of a shaft or frequency of piston oscillations in free piston machines (typically up to 3000-4000 RPM).

In order to reduce the size and weight of these machines, designers may separate the crank-case from the gas circuit of the engine using a "sealing" of the vertical rod connecting pistons and drive mechanism (i.e. a so called unpressurised crank-case).

Such a sealing has been achieved only on a very limited number of Stirling machines, and even in those engines the working fluid in the internal gas circuit has to be replenished repeatedly, since it is not possible to fully eliminate working fluid leakages in a rod sealing.

Furthermore, in free piston machines there is no conventional drive mechanism and pistons are driven reciprocally utilising the gas forces provided in the internal gas circuit of machines and mechanical springs. The oscillating motion of the cold piston may be converted into electrical power by attaching rare-earth magnets to the piston and these magnets are surrounded by copper coils (i.e. the concept of linear generator). Such machines do not have a large crankcase and the engine is fully sealed by placing the linear alternator inside the engine casing. Its specific weight and dimensions are significantly improved than those of conventional kinematical machines, but so far the power output is limited to about 3 to 10 kW (Kilowatts), which is considerably lower than the output of conventional kinematical engines. The frequency of oscillation of the pistons corresponds to a rotational speed of the shafts between 2000 and 4000 RPM (revolutions per minute).

The solution to the problems of reciprocating piston machines is believed to be in rotatory machines. Thus considerable effort has gone into the development of rotary Stirling engines/machines.

For example, prior art document U.S. Ser. No. 13/795,632 describes a rotary Stirling cycle engine using "hot" and "cold" gerotor sets that are mounted on the same shaft and which are separated by an insulation barrier. The barrier provides a regenerative gas passage allowing gases to flow through, therefore, connecting the displacing chambers of the "hot" and "cold" gerotor sets. The gerotor Stirling-cycle engine may be used for generating electricity or mechanical power.

Prior art document U.S. Ser. No. 05/790,904 discloses another example of a Stirling-cycle machine having a rotary mechanism. In this particular design, a rotary vane expander and a rotary vane compressor are mounted on the same shaft, wherein each vane unit forms four working volumes. Corresponding working volumes of the expander and the compressor are connected via a set of heat exchangers that are provided in the casing of the expander and in the shaft.

All of these prior art examples have the same essential features of Stirling-cycle machines, i.e. a harmonic or near harmonic variation of continuously connected corresponding working spaces in the expander and the compressor units. Thus, once respective chambers are connected through a set of heat exchangers, the working gas flows between corresponding working spaces in a reciprocating motion. However, it can be understood by the person skilled in the art that the described rotary mechanisms are very complex and come with disadvantages of their own.

Consequently, rotary mechanisms such as twin-screw or scroll mechanisms were considered for use in Stirling-cycle machines. Twin-screw mechanisms in particular have been a very popular choice for compressors. FIGS. 3 (*a*) to (*d*), for example, shows a full cycle of a twin-screw compressor 30. During operation (i.e. rotation of the twin-screw shafts), two intermeshing and counter-rotating male and female rotors trap a working fluid 32 (e.g. gas) in-between corresponding lobes and the enclosing casing 34. The gas is pushed forward axially by the intermeshing male and female lobes, so that the volume of the chamber, created by the intermeshing male and female lobes, is reduced progressively, causing the trapped gas to be compressed.

As shown in FIG. 3, (a) the gas 32 is taken in through an intake port 36, (b) the gas 32 is then trapped and moved in an axial direction, (c) the gas is compressed by the reducing chamber volume provided by the intermeshing lobes, and (d) the gas 32 is discharged through a discharge port 38.

FIGS. 4 (*a*) to (*d*) show an alternative rotary mechanism that can be used for compressing or expanding a working fluid, in particular, FIG. 4 illustrates a scroll compressor 40 that comprises two nested identical scrolls 42, 44, one of which is rotated through 180 degrees with respect to the other. In the classical design, both scrolls 42, 44 are circle involutes, one scroll 42 or spiral is rotatable and configured to orbit in a path defined by a matching fixed scroll 44. The fixed scroll 44 may be attached to a compressor body, wherein the orbiting scroll 42 may be coupled to the crankshaft so that its orbiting motion creates a series of gas pockets travelling between the two scrolls 42, 44. The formed pockets draw in the gas and move it from the outer portion to the centre of the scrolls 42, 44, where the gas is discharged. As the gas is moved towards the centre, the pocket volume is reduced and its temperature and pressure are increased to a desired discharged pressure. It is understood that both, scroll and twin-screw mechanisms, may also be operated in reverse mode, i.e. as expander, by simply reversing the direction of rotation.

Another example of a rotary mechanism used for compression or expansion of gases is a conical screw rotary compressor 50 (for example as manufactured by VERT Rotors Ltd), as shown in FIG. 5. The mechanism consists of a rotating internal rotor 52 and a rotating external rotor 54. The internal and external rotors 52, 54 are driven by an electrical motor via a synchronisation mechanism. Rotational motion of both rotors 52, 54, internal and external, causes the gas to be moved along the rotational axis, so as to displace and compress the gas. During operation, low pressure gas is supplied to the inlet on the large diameter side 56, which is then compressed to higher pressure and discharged through the outlet on the smaller diameter side 58. This rotary mechanism 50 may also be reversed, so as to be used as an expander. In FIG. 5, two different geometries of the rotary conical screw compressor are shown (a) a 2+3 profile, and (b) a 3+4 profile.

However, the cyclic volume changes provided by the twin-screw, scroll or conical screw rotary mechanisms follow a linear or nonlinear saw-tooth function as shown in FIG. 6, which shows an example of a volume change of a working fluid during expansion (positive ramp) and compression (negative ramp). Here, the slow ramps may be defined by a linear function (i.e. a straight line), but may also be described by a nonlinear function (e.g. part of a harmonic or non-harmonic function).

Yet, the saw-tooth character of the working fluid volume variation, as provided by these rotary machines, has made twin-screw, scroll or conical screw mechanisms unsuitable for use in the Stirling cycle.

Currently available thermodynamic apparatuses that utilise twin-screw or scroll mechanism either are applied in the Rankine or the Joule/Bryton cycle, each of which requires an axial flow of the working fluid in one direction only. For example prior art documents DE10123 078 or AT412663 describe thermodynamic cycles utilising twin-screw expanders.

In particular, DE10123078 discloses a machine that operates on a closed thermodynamic cycle where the high-pressure gas is supplied into and expanded by a twin-screw mechanism. The work generated by the gas expansion is converted into useful mechanical work through the rotating twin-screw shafts, before the working fluid is then re-heated (and re-pressurised) and directed back to the twin-screw mechanism, where the cycle is repeated.

Another example of a rotary thermodynamic engine (now utilising a scroll mechanisms), is disclosed in a publication by Youngmin Kim, Dongkil Shin, Janghee Lee and Kwenha Park ("Noble Stirling engine employing scroll mechanism", Proceedings of the 11$^{th}$ International Stirling Engine Conference, 19-21 Sep. 2004, pp. 67-75), but a simple analysis reveals that the so called Stirling engine actually operates on the closed Joule/Bryton cycle, because the gas flow is circled around in one direction and not in a reciprocating motion.

Accordingly, it is an object of the present invention to provide a Stirling-cycle apparatus that is adapted to utilise rotary expander and compressor mechanisms, such as twin-screw, scroll or conical screw mechanism, even if the provided working fluid volume changes are described by linear or non-linear saw-tooth waveforms. Furthermore, it is a particular object of the present invention to provide a rotary Stirling-cycle cooler that can be made smaller than currently available Stirling-cycle cooler, and which has an improved efficiency.

SUMMARY OF THE INVENTION

Preferred embodiment(s) of the invention seek to overcome one or more of the above disadvantages of the prior art.

According to a first embodiment of the invention there is provided a Stirling-cycle apparatus comprising:

a hermetically sealable housing;

a first rotary displacement unit in fluid communication with a second rotary fluid displacement unit, each operably mounted in a separate, fluidly sealed portion within said housing and adapted to provide a cyclic change of at least one thermodynamic state parameter of a working fluid during use, each said first and second rotary displacement unit comprising:

a compressor mechanism, having a first compressor working chamber that is adapted to receive a first portion of said working fluid, and at least a second compressor working chamber that is adapted to receive a second portion of said working fluid, said first compressor working chamber comprises a first outlet port and said second compressor working chamber comprises a second outlet port;

an expander mechanism, having a first expander working chamber that is adapted to receive said first portion of said working fluid, and at least a second expander working chamber that is adapted to receive said second portion of said working fluid, said first expander working chamber comprises a first inlet port and said second expander working chamber comprises a second inlet port;

a drive coupling assembly, adapted to operably and operatively couple said first expander mechanism to said first compressor mechanism, comprising:

a rotating valve mechanism, adapted to provide a predetermined sequence of a cyclic fluid exchange between said first compressor working chamber and said first expander working chamber, and between said second compressor working chamber and said second expander working chamber, at predetermined intervals of the angle of rotation of said first and second rotatory displacement unit;

an actuator, operably coupled to said first and second rotary displacement unit, and adapted to synchronously link the rotational movement of said first rotary displacement unit with said second rotary displacement unit, such that said first predetermined cyclic change of at least one thermodynamic state parameter of said working fluid is offset in relation to said second predetermined cyclic change of at least one thermodynamic state parameter of said working fluid by a predetermined phase angle, during use.

The apparatus of the present invention provides the advantage that linear or non-linear "saw-tooth like" cyclic changes of at least one thermodynamic state parameter (i.e. volume) of the corresponding rotary compressor and expander mechanisms of the two rotary displacement units are paired and combined in such a way to provide a total variation of working space volumes that follows a periodic near-harmonic function that is typical for conventional Stirling cycle machines (e.g. piston motion), therefore providing a genuine rotary Stirling-cycle apparatus that is simpler in construction and which has an improved efficiency and performance, especially when provided in miniaturised form. The apparatus of the present invention can be operated so as to provide mechanical work, but also in reverse as a cooler or heat pump.

Advantageously, said first drive coupling assembly may further comprise at least one first drive shaft and at least one first shaft casing having an inner wall and which is configured to operably enclose said at least one first drive shaft.

Advantageously, said at least one first shaft casing may comprise a plurality of axially-spaced and partially circumferential first fluid channels provided at respective predetermined first axial positions extending over a first circumferential segment of said inner wall, and a plurality of axially-spaced and partially circumferential second fluid channels, provided at respective predetermined second axial positions extending over a second circumferential segment of said inner wall, and wherein said first circumferential segment is provided radially opposite said second circumferential segment, and wherein each one of said first axial positions is axially offset from each one of said second axial positions.

Preferably, each one said plurality of axially-spaced and partially circumferential first and second fluid channels may subtend an angle greater than 180 degrees.

Advantageously, said at least one drive shaft may comprise a first set of two corresponding conduits, a first conduit having a first opening fluidly coupled to said first outlet port and a second conduit having a first opening fluidly coupled to said first inlet port, each one of said corresponding said first and second conduits has two conjoined axially adjacent second openings exiting radially out of said drive shaft at a first predetermined radial angle, wherein a first one of said two conjoined axially adjacent second openings is adapted to fluidly engage with one of said plurality of first fluid channels, and a second one of said two conjoined axially adjacent second openings is adapted to fluidly engage with one of said plurality of second fluid channels.

Even more advantageously, said at least one drive shaft may comprise at least a second set of two corresponding conduits, a first conduit having a first opening fluidly coupled to said second outlet port and a second conduit having a first opening fluidly coupled to said second inlet port, each one of said corresponding said first and second conduits has two conjoined axially adjacent second openings exiting radially out of said drive shaft at a second predetermined radial angle, wherein a first one of said two conjoined axially adjacent second openings is adapted to fluidly engage with one of said plurality of first fluid channels, and a second one of said two conjoined axially adjacent second openings is adapted to fluidly engage with one of said plurality of second fluid channels.

Even more advantageously, each one of said plurality of first fluid channels may be fluidly coupled to a corresponding one of said plurality of second fluid channels, so as to allow a predetermined sequence of fluid exchange between said first compressor working chamber and said first expander working chamber, and between said second compressor working chamber and said second expander working chamber, during use.

Advantageously, a first and a second working space may be formed for each one of fluidly coupled said first compressor working chamber and said first expander working chamber, and fluidly coupled said second compressor working chamber and said second expander working chamber, in said first rotary displacement unit.

Advantageously, a first and a second working space may be formed for each one of fluidly coupled said first compressor working chamber and said first expander working chamber, and fluidly coupled said second compressor working chamber and said second expander working chamber, in said second rotary displacement unit.

Advantageously, each one of said first and second working space of said first rotary displacement unit may be in fluid communication with a corresponding one of said first and second working space of said second rotary displacement unit.

Preferably, each one of said corresponding fluidly coupled first and second fluid channels of said first rotary displacement unit may be in fluid communication with a respective one of each one of said corresponding fluidly coupled first and second fluid channels of said second rotary displacement unit.

Advantageously, each fluid communication between each one of said corresponding fluidly coupled first and second fluid channels of said first rotary displacement unit and each one of said corresponding fluidly coupled first and second fluid channels of said second rotary displacement unit may comprise any one or any serial combination of a first heat exchanger, a regenerator and a second heat exchanger.

Preferably, said first heat exchanger may be adapted to provide heat to said working fluid, and wherein said second heat exchanger may be adapted to remove heat from said working fluid. This provides the advantage that the apparatus can be operated in different modes, for example, as a cooler or as a heat pump depending on where the first and second heat exchangers are located in combination with the regenerator.

Even more preferably, said regenerator may be fluidly coupled between said first and second heat exchanger.

Alternatively, said first heat exchanger is an integral part of said first rotary displacement unit and/or said second heat exchanger is an integral part of said second rotary displacement unit.

Preferably, each one of said first and second rotary displacement unit may comprise a twin-screw mechanism.

Alternatively, each one said first and second rotary displacement units may comprise a scroll mechanism or a rotary conical screw mechanism.

In another alternative embodiment, each one of said first and second displacement unit may comprise any one of a twin-screw mechanism, scroll mechanism or a rotary conical screw mechanism.

Advantageously, said actuator may comprise a motor and a transmission adapted to synchronously drive said first and second rotary displacement units.

Alternatively, said actuator may comprise a motor and a transmission adapted to be powered by any one of said first and second rotary displacement units.

Advantageously, each one of said compressor and expander mechanism of said first rotary displacement unit, and each one of said compressor and expander mechanism of said second rotary displacement unit, may be provided in a discrete and hermetically sealed portion of said housing.

Preferably, said first rotary displacement unit may be a compression unit, and wherein said second rotary displacement unit may be an expansion unit.

Alternatively, the first rotary displacement unit may be an expansion unit and the second rotary displacement unit may be a compression unit, depending on the application of the apparatus, i.e. heat pump, cooler or engine.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION OF THE PREFERRED EMBODIMENT(S)

The exemplary embodiments of this invention will be described in relation to a rotary Stirling-cycle cooler. However, it should be appreciated that, in general, the rotary Stirling-cycle apparatus of this invention will work equally well in a Stirling engine mode (i.e. output of mechanical work) or heat-pump (output of heat).

In addition, meshing male and female screw rotors may be provided with different ratios for the number of lobes. Theoretically, the ratio may start at '1' (i.e. '2/2'), but in practice other (e.g. greater) ratios may be used. Typical examples of ratios used in practice may be '3/4', '3/5', '4/6', '5/7', '6/8' etc. Also, the screw lobes may have a symmetric or asymmetric profile. For the sole purpose of illustrating the basic principle of the invention, the example embodiment comprises the more simplistic symmetrically profiled screw rotors with '2/2' ratio lobes (i.e. the ratio is equal to '1'). Also, it is understood by the person skilled in the art that optimal performance may only be achieved utilising any other (i.e. more suitable) ratio and/or lobe profile (i.e. asymmetric or symmetric). However, the basic principle of the invention is applicable for any suitable lobe number ratio and lobe profile.

Figure 8:
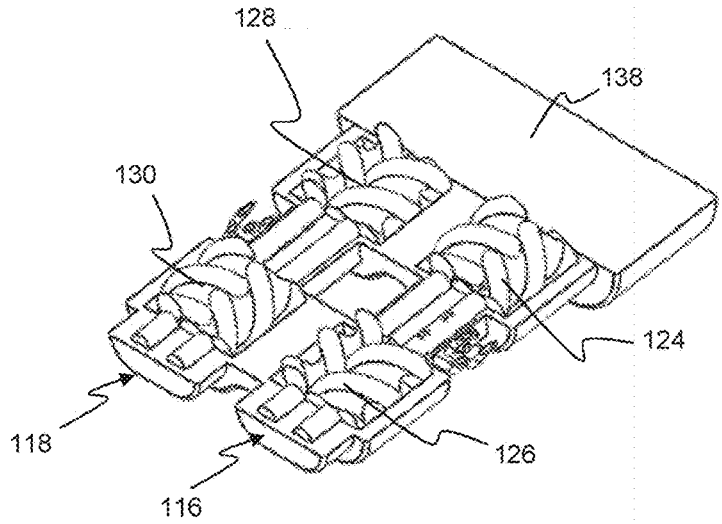
FIG. 8 shows a partially cross-sectioned isometric view of the interior of the apparatus shown in FIG. 7.
Figure 9:
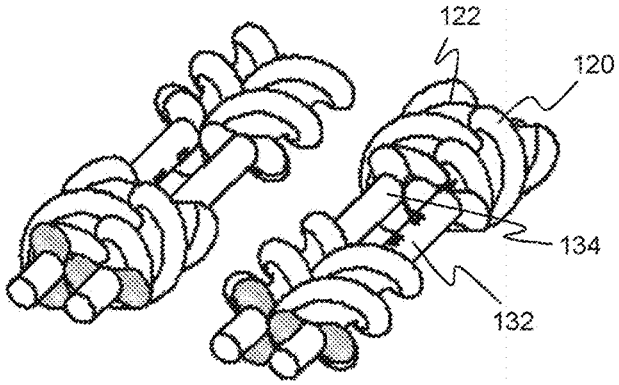
FIG. 9 shows an isometric view of the two coupled twin-screw mechanisms of the apparatus shown in FIGS. 7 and 8, each twin-screw mechanism comprises a compression chamber and an expansion chamber.
Figure 10:
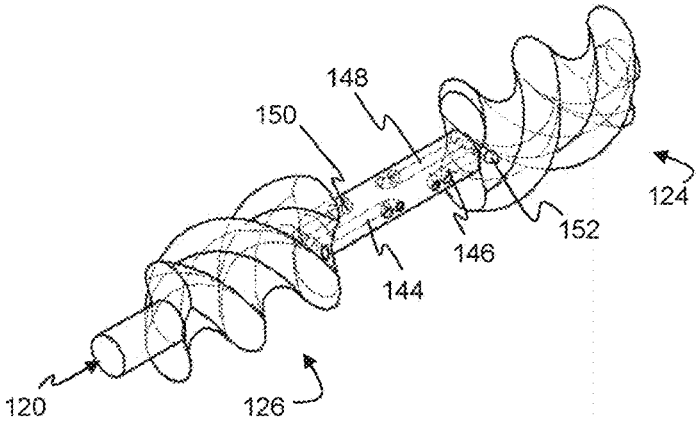
FIG. 10 shows an isometric view of one rotor of the twin-screw mechanism, including the interior conduits (dashed lines) and outlets/inlets.

Referring now to FIGS. 7 to 11, a first embodiment of the Stirling-cycle apparatus 100 of the invention comprises an "expanding" or "cold" unit 102 and a "compression" or "warm" unit 104. Each one of the "cold" 102 and "warm" unit 104 further compromises a compressor mechanism 106 and an expander mechanism 108. The "cold" 102 and "warm" 104 units are in fluid communication via four sets of heat exchangers, each including a serially arranged "cold" heat exchanger 110, a regenerator 112 and a "warm" heat exchanger 114. Each one of the "cold" unit 102 and the "warm" unit 104 comprises a twin-screw mechanism 116 and 118, which consists of two twin-screw rotors 120, 122 as shown in FIGS. 8 and 9. Each one of the twin-screw mechanisms 116 and 118 has a compression part 124, 128 and an expansion part 126, 130. Respective, compression and expansion parts 124, 126, 128, 130 of each one of the male 120 and female 122 rotors are coupled by a single drive shaft 132 and 134, wherein the expansion part 126, 130 is an identical mirror-image of the compression part 124, 128.

Figure 11:
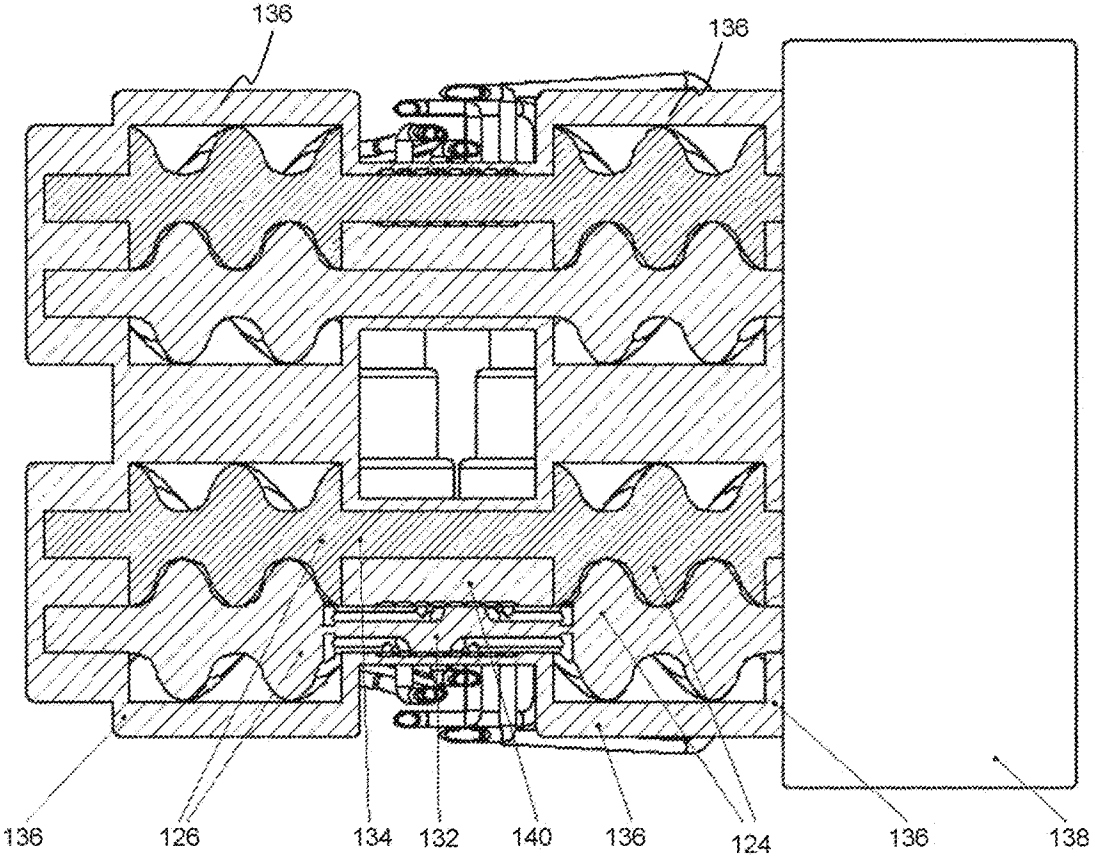
FIG. 11 shows a schematic sectional view of rotary units with their interior compression/expansion chambers (as in the apparatus shown in FIG. 7)
Figure 12:
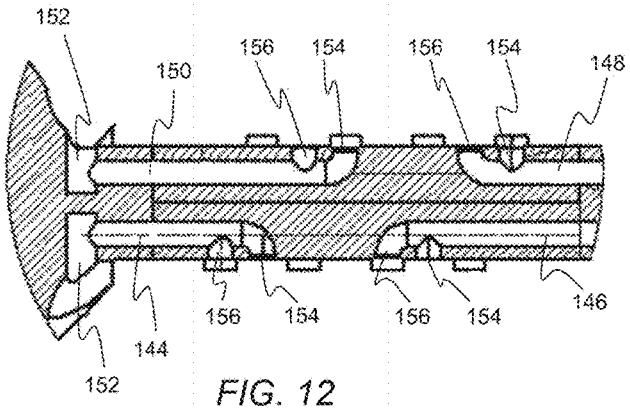
FIG. 12 shows a close-up sectional view of the shaft exposing the interior conduits of the rotating-valve mechanism.
Figure 13:
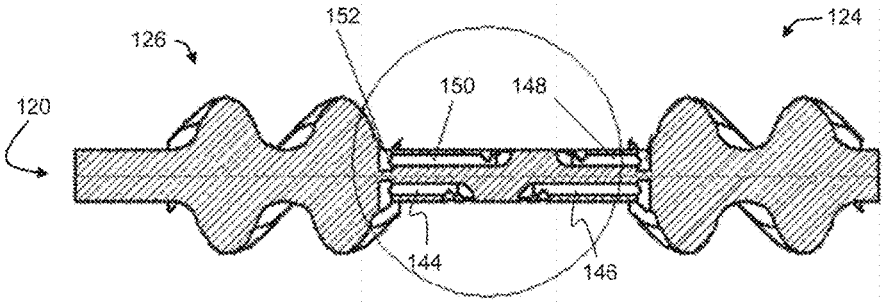
FIG. 13 shows a sectional view of a male rotor shaft of the twin-screw mechanism.
Figure 14:
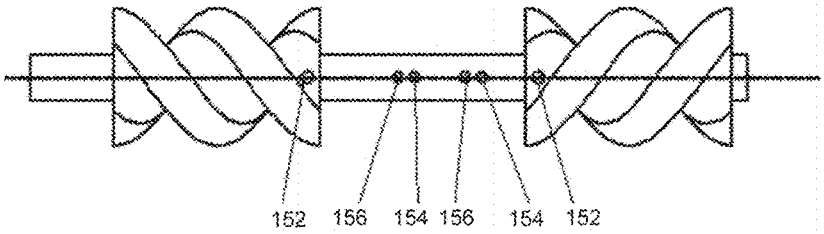
FIG. 14 shows a top-view of the male rotor shaft in FIG. 13, showing the openings of the interior conduits.

Furthermore, each one of the two compression parts 124, 128 and the two expansion parts 126, 130 are arranged in their own hermetically sealed enclosure 136 (see FIG. 11).

A motor (not shown) and transmission (not shown) are operatively coupled to respective the twin-screw mechanisms 116, 118, wherein the rotation of male 120 and female 122 rotors is synchronised using the transmission (e.g. meshed gears that are mounted as a drive coupling assembly, for example, in the box 138. Box 138 also comprises an actuator (i.e. an efficient and controllable electrical motor), which is adapted to drive the twin-screw mechanisms via the transmission. Alternatively, the transmission (i.e. bearings, gear mechanism) may also be arranged in a different part of the housing, e.g. casing 140 surrounding the shafts 132, 134 of the twin-screw mechanisms 116, 118.

Referring now to FIGS. 10, 12, 13 and 14, a set of corresponding conduits 144, 146, 148, 150 are provided within the shaft 132 of the male rotor 120. At the high pressure end of the compression part 124 and the low pressure end of the expansion part 126, a radially arranged fluid port 152 is provided between two neighbouring lobes of the male screw rotor 120 and fluidly coupled to a respective one of the set of conduits 144, 146, 148, 150 (which are axial internal cylindrical channels), as shown in detail in FIGS. 12 and 13. Each one of the fluid conduits 144, 146, 148, 150 has a first outlet 154 and a second outlet 156, wherein first and second outlet of each one of the fluid conduits 144, 146, 148, 150 are arranged next to each other.

Figure 15:
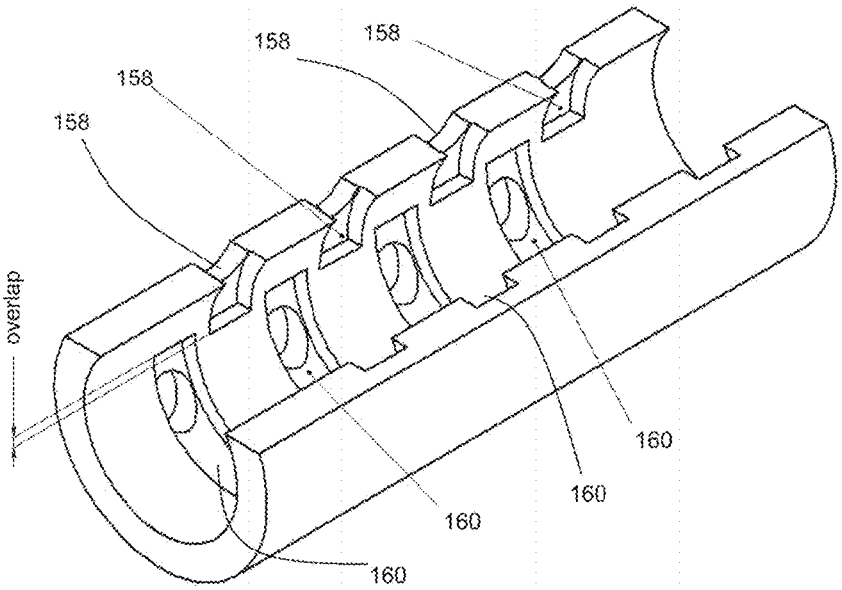
FIG. 15 shows an isometric, sectioned view of a portion of the casing of the rotating valve mechanism including the circumferential and axially offset fluid channels.
Figure 16:
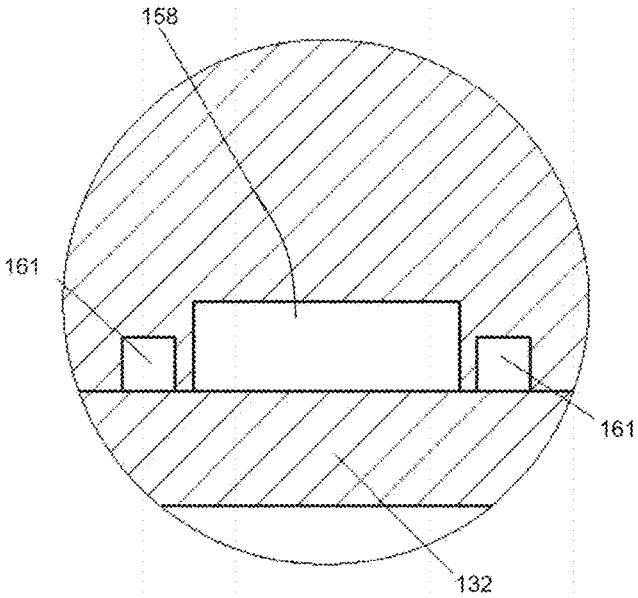
FIG. 16 shows a close-up sectional view of a fluid channel and its adjacent sealing rings arranged in the casing surrounding the rotor shaft of the rotating valve mechanism.
Figure 17:
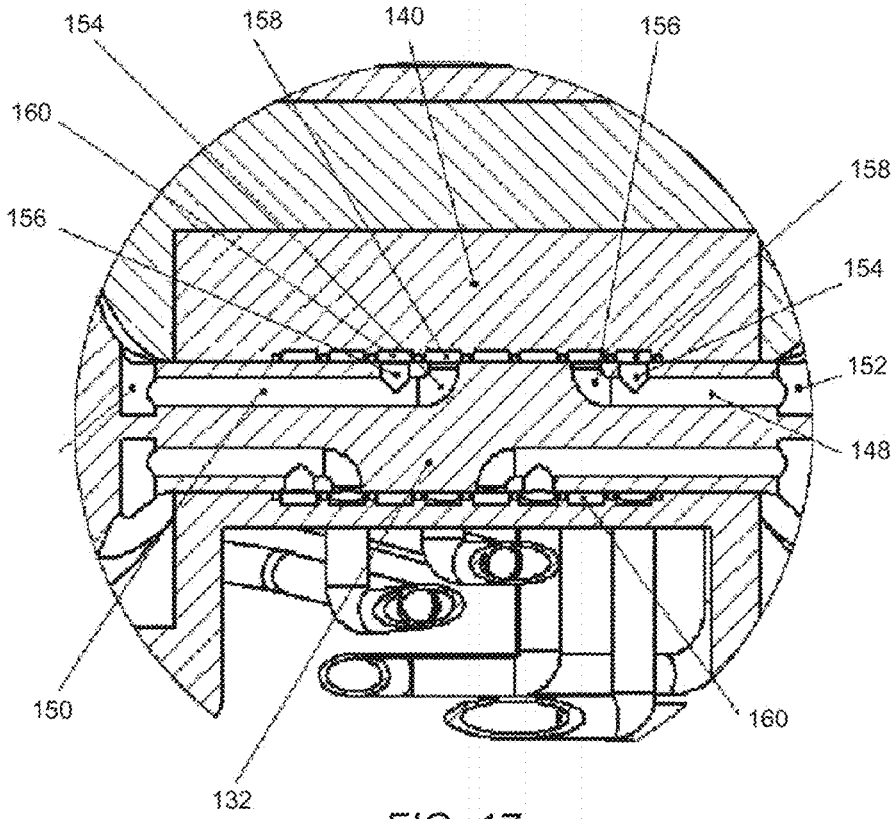
FIG. 17 shows a detailed sectional close-up view of the rotational valve assembly of the shaft, casing and conduits.

Referring now to FIGS. 15, 16 and 17, a first set of partially circumferential fluid channels 158 (i.e. slots), in the form of a major circular sectors with their central angle more than 180 degrees, is made at respective predetermined axial positions in a first portion of the casing surrounding the shaft 132 of the male rotor 120 (see FIG. 15). A second set of partially circumferential fluid channels 160 (i.e. slots), in the form of a major circular sectors with their central angle more than 180 degrees, is made at respective predetermined axial positions in a second portion of the casing surrounding the shaft 132 of the male rotor 120 (see FIG. 15), wherein the first portion of the casing is radially opposite to the second portion of the casing (see FIG. 15). Furthermore, each one of the first set of partially circumferential fluid channels 158 is axially offset from each one of the second set of partially circumferential fluid channels 160.

As shown in FIG. 17, each one of the first outlets 154 is arranged so as to allow only fluid coupling with a respective one of the first set of partially circumferential fluid channels 158, and each one of the second outlets 156 is arranged so as to allow only fluid coupling with a respective one of the second set of partially circumferential fluid channels 160.

As shown in FIG. 16, all fluid channels 158, 160 are separated by "O" type sealing rings 161 that arranged within the portion of the casing surrounding the shaft 132. Furthermore, in order to reduce potential gas leakage in the gaps between rotors, or rotors and casing, suitable sealing arrangements may be applied. For example, sealing strips may be provided in grooves running along the ridges of the lobes, or Teflon and other suitable sealing materials may be used as sealing strips to close any gaps. In addition, the materials used for manufacturing the male and female rotors (e.g. non-metallic material), casing or heat exchangers may differ depending on the temperature used in the Stirling cycle.

Figure 18:
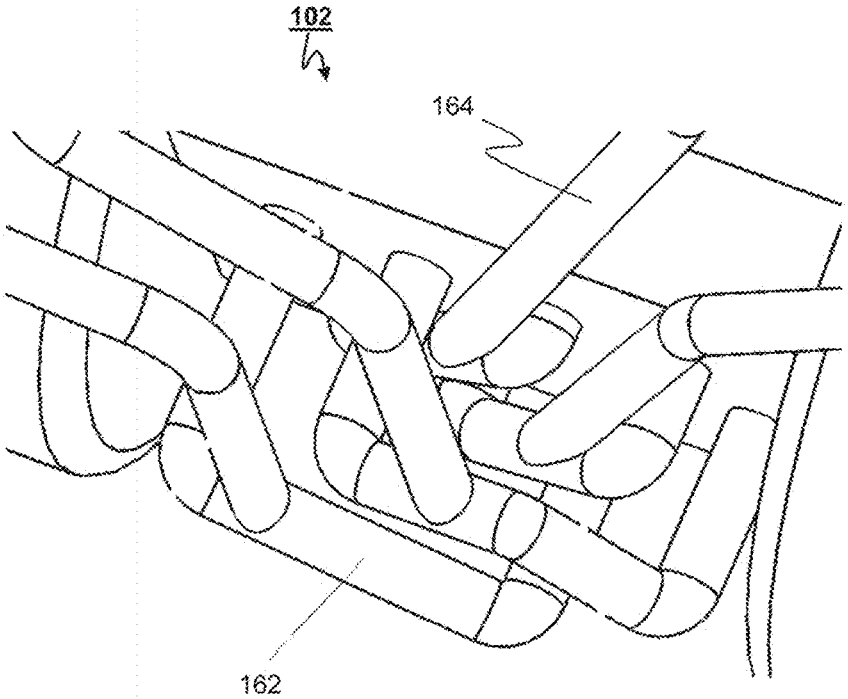
FIG. 18 shows the pipes connecting the corresponding compressor and expander spaces (a) in the "cold" rotary displacement unit and (b) in the "warm" rotary displacement unit of the apparatus of the present invention, forming working spaces which are connected to each other via corresponding sets of heat exchangers.
Figure 18:
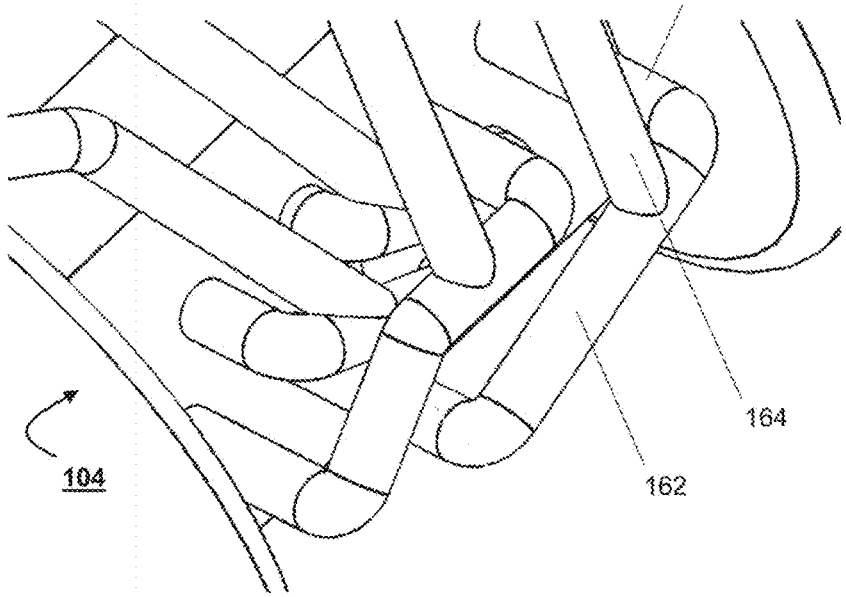

Referring now to FIGS. 18 (*a*) and (*b*), in each one of the "cold" unit 102 and "warm" unit 104, each one of the first set of fluid channels 158 is fluidly coupled with a corresponding one of second set of fluid channels via a fluid connection 162 (e.g. pipe). Each one of the fluid connection 162 of the "cold" unit is fluidly coupled with a corresponding fluid connection 162 of the "warm" unit via a pipe 164. As described previously, a series of a "cold" heat exchanger 110, a regenerator 112 and a "warm" heat exchanger 114 is fluidly coupled in the fluid path of each pipe 164.

Referring now to FIGS. 19 to 24, during operation of the apparatus 100 of the present invention (i.e. in cooling mode), the drive shafts 132, 134 of each one of the two twin-screw mechanisms 116, 118 are rotated synchronously via the motor and transmission (not shown). The lobes of the corresponding male and female rotors 120, 122 intermesh, so as to form two compression chambers and two expansion chambers (i.e. two-lobe screw rotors will form two separate chambers) for the "cold" unit 102 and the "warm" unit 104, respectively.

Figure 20:
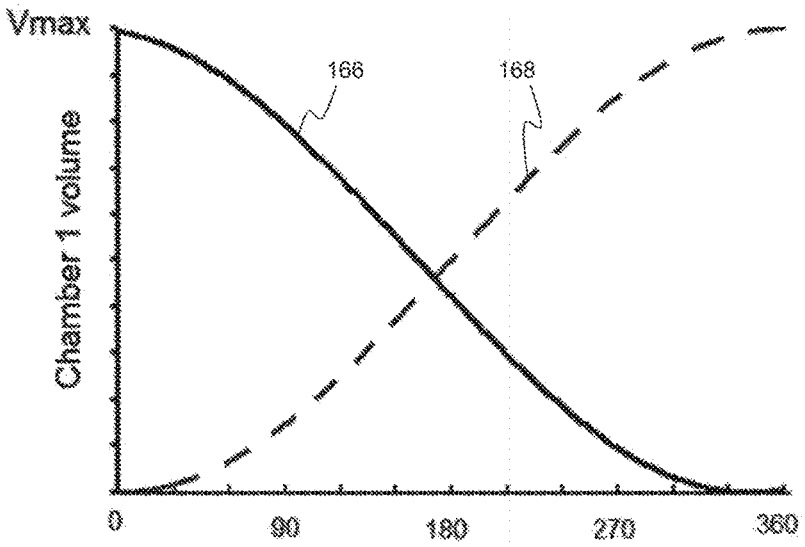
FIG. 20 shows a diagram of the volume variation in a first chamber of the compressor (solid) and expander (dashed) in the "cold" unit.
Figure 21:
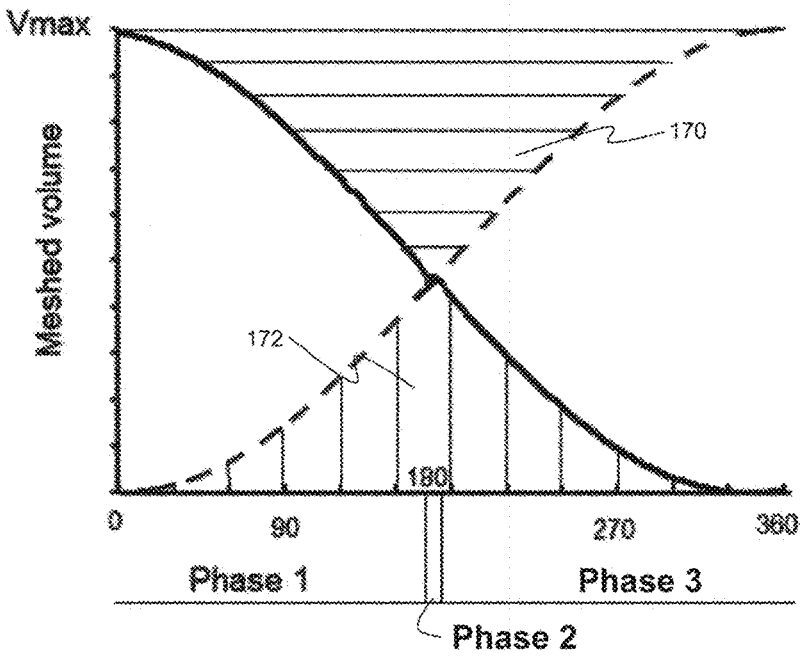
FIG. 21 shows a diagram of the volume variation in a first chamber of the "cold" unit over the cycle, illustrating the formation of the two working spaces.

The variation of volumes of one of the chambers (i.e. chamber 1) in the compression part 128 and one of the chambers (i.e. chamber 1) in the expansion part 130 of the "cold" unit 102 is shown in FIG. 20. The variation of compression volume 166 is identical to the variation of the expansion volume 168 but, because the volume change is formed by a mirror-symmetrical pair of twin-screw rotors that are located at opposite ends of the twin-screw mechanism 118 of the "cold" unit 102, the volume change 168 is in anti-phase to the volume change 166 (see FIG. 20).

The following is a description of the individual processes taking place in the apparatus 100 of the present invention. A first working space 170 is formed during reciprocating compression and expansion of the working fluid (i.e. gas) trapped in chamber 1 of the compression part 128 and the expansion part 130 of the twin-screw mechanism 118 of the "cold" unit 102, and a second working space 172 is formed during reciprocating compression and expansion of a fluid volume (i.e. gas) trapped in chamber 2 of the compression part 128 and the expansion part 130 of the twin-screw mechanism 118 of the "cold" unit 102. Equivalent first and second working spaces (not shown) are formed by the twin-screw mechanism 116 of the "warm" unit 104.

To simplify the description of the process, chamber 1 of the "cold" unit 102 is considered as representative example for this embodiment of a cooling machine. The whole cycle (i.e. 360 degrees rotation of the twin-screw rotors 116, 118) can be split into three distinctive phases:

Phase 1:

The duration is from 0 degrees rotation of the shafts 132, 134 to the start of the overlap of the offset partially circumferential fluid channels 158, 160. Here, respective first set of fluid channels 158 remain aligned with corresponding first outlets 154. The first set of fluid channels 158 are fluidly connected to corresponding second set of fluid channels 160 through external fluid connections 162 (see FIG. 18). Also, second fluid channels 160 are misaligned from respective second outlets 156 (see FIGS. 12 and 19). Essentially, the above paired fluid channels 158, 160 and corresponding axially offset first and second outlets 154, 156 function as rotating valve mechanism that is adapted to separate and connect the expansion part 130 and compression parts 128 of chamber 1 in the timely manner. So, during this first phase, the gas located in chamber 1 of the expansion part 130 of the "cold" unit 102 is being expanded to approximately half of the full expansion, and the gas located in chamber 1 of the compression part 128 of the "cold" unit 102 is being compressed to approximately half of the full compression.

Phase 2:

The duration is from the start of the overlap to the completion of the overlap of the offset and partially circumferential fluid channels 158, 160. Close to the middle of the cycle, a fluid connection takes place between the chamber 1 volume of the compression part 128 and the chamber 1 volume of the expansion part 130. The duration of this phase is predetermined by the predefined overlap between the two axially offset and partially circumferential first and second sets of fluid channels 158, 160. The exact overlap is optimised to "smoothen" the gas exchange between the chamber 1 volumes of the compression part 128 and the expansion part 130, i.e. so as to minimise or even avoid pressure shocks between the compression part 128 and the expansion part 130.

Phase 3:

The duration is from the completion of the overlap to the full 360 degrees of the cycle. During this phase, respective second set of fluid channels 160 remain aligned with corresponding second outlets 156. As mentioned in the description of phase 1, each one of the first set of fluid channels 158 is fluidly connected to a corresponding one of the second set of fluid channels 160 through external fluid connections-162 (see FIGS. 18 and 19). First fluid channels 158 are misaligned from corresponding first outlets 154. Thus, the gas located in chamber 1 of the expansion part 130 of the "cold" unit 102 is being expanded from approximately half to the full expansion, and the gas located in chamber 1 of the compression part 128 of the "cold" unit 102 is being compressed from approximately half to the full compression.

As mentioned previously, after the overlap period is completed, the volume of gas that is close to being compressed during the first half of the cycle in the compression part 128 will be expanding in the expansion part 130 during the second half of the cycle. Simultaneously, the volume of gas that is close to being expanded in the expansion part 130 will go through the compression process in the compression part 128 during the second half of the cycle. Thus, the magnitude of volume variation in the two formed working spaces 170 and 172 is approximately the same (see FIG. 21). Also (again, as mentioned previously), because the rotors 120, 122 of the twin-screw mechanisms 116, 118 have two lobes, two equivalent working spaces are formed for chamber 2 of the expansion part 130 and the compression part 128 by pairing respective first and second fluid channels with corresponding first and second outlets of the other set of conduits (e.g. first corresponding set of conduits 144, 146, second corresponding set of conduits 148, 150). Consequently, for the two-lobed twin-screw mechanisms 116, 118, there will be a total of four working spaces formed in the "cold" unit 102, and a total of matching four working spaces will be formed in the "warm" unit 104.

Figure 19:
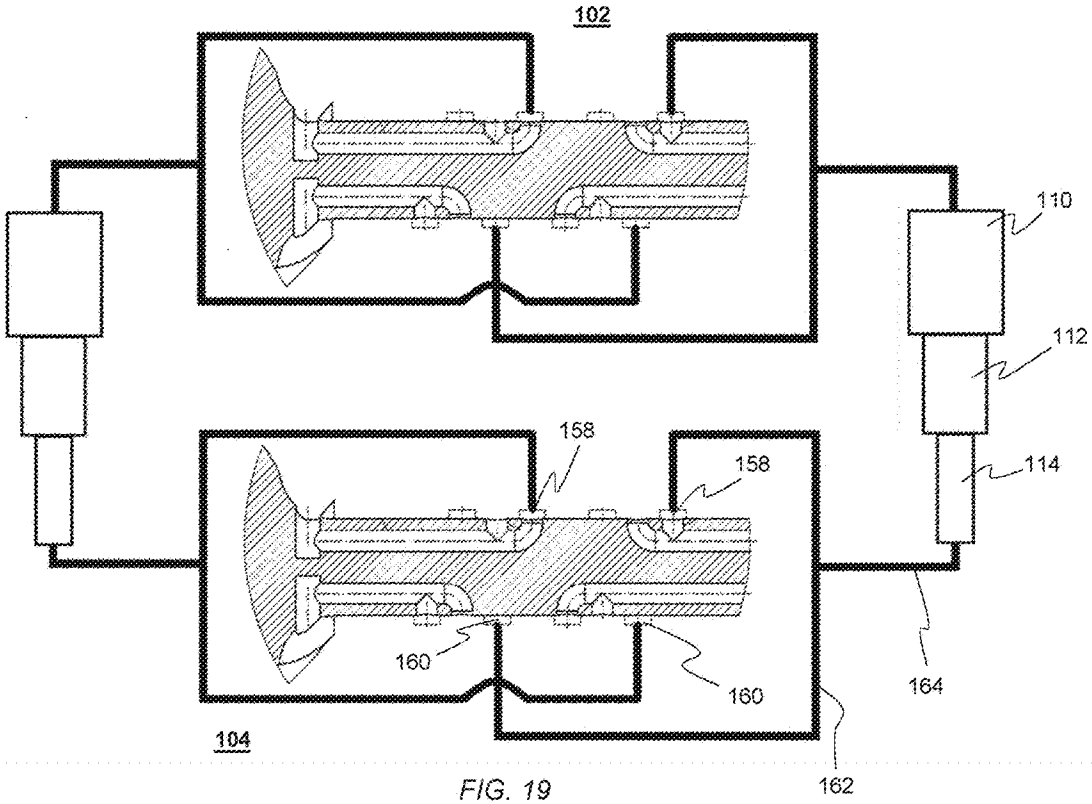
FIG. 19 shows a schematic diagram of the fluid connections between the two corresponding working spaces of the "cold" and "warm" rotary displacement units.

FIG. 19 shows a simplified schematic of the "cold" and "warm" unit 102, 104 and corresponding fluid connections (via series of heat exchangers 110, 114 and regenerator 112) between two working spaces.

Furthermore, it is understood that the variation of volume in each working space in the "warm" unit 104 "follows" the variation of volume of its corresponding paired working space in the "cold" unit 102, but with a delay of 90 to 120 degrees of the shaft angle (phase angle). In this particular example of the embodiment of the present invention, the variation of volume in each working space in the "warm" unit 104 may follow the variation of volume of its corresponding paired working space in the "cold" unit 102 with a 90 degree delay. However, it is understood by a person skilled in the art that other phase angles delays may be used between the "cold" unit 102 and the "warm" unit 104 so as to control the output of the Stirling-cycle apparatus 100 (e.g. cooling output).

Figure 22:
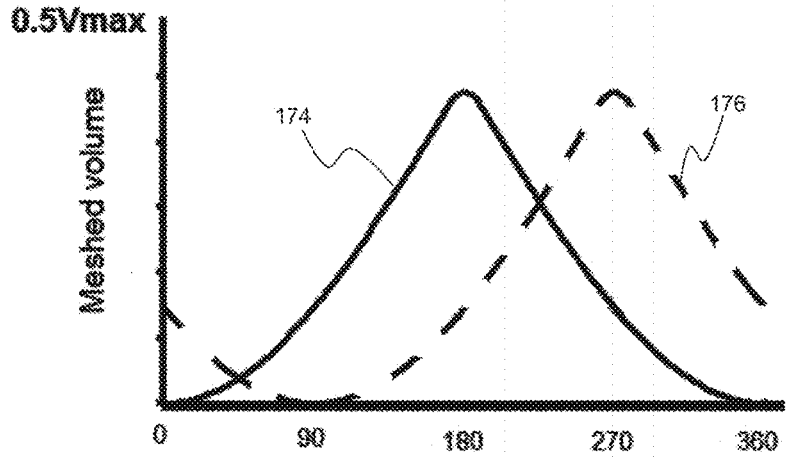
FIG. 22 shows a diagram of the paired working space volume variations in the "cold" (solid) and "warm" (dashed) unit.

A typical diagram of the variations of the paired working volume 174 in the "cold" unit 102 and the paired working volume 176 in the "warm" unit 104 is shown in FIG. 22. The rotation of the twin-screw mechanism 116 of the "warm" unit 104 is 90 degrees offset from the twin-screw mechanism 118 of the "cold" unit.

Figure 1:
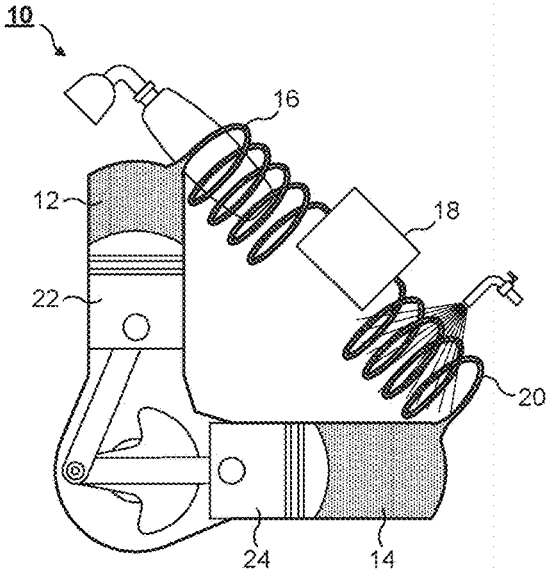
FIG. 1 (Prior Art)
FIG. 1 shows a kinematic drive Stirling engine with "hot" and "cold" cylinders, a heater, cooler and regenerator.
Figure 2:
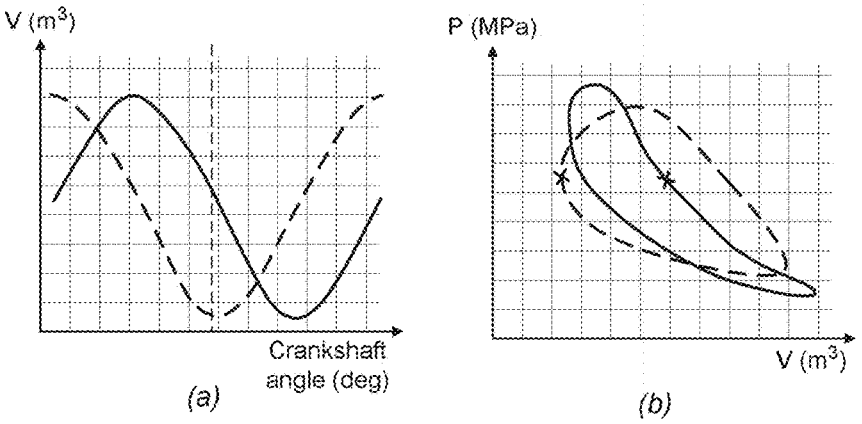
FIG. 2 (Prior Art)
FIG. 2 shows (a) a diagram of volume variation in a "hot" (dashed) and "cold" (solid) cylinder and (b) a PV-diagram of "hot" (dashed) and "cold" (solid) cylinders in the Stirling cycle engine.
Figure 3:
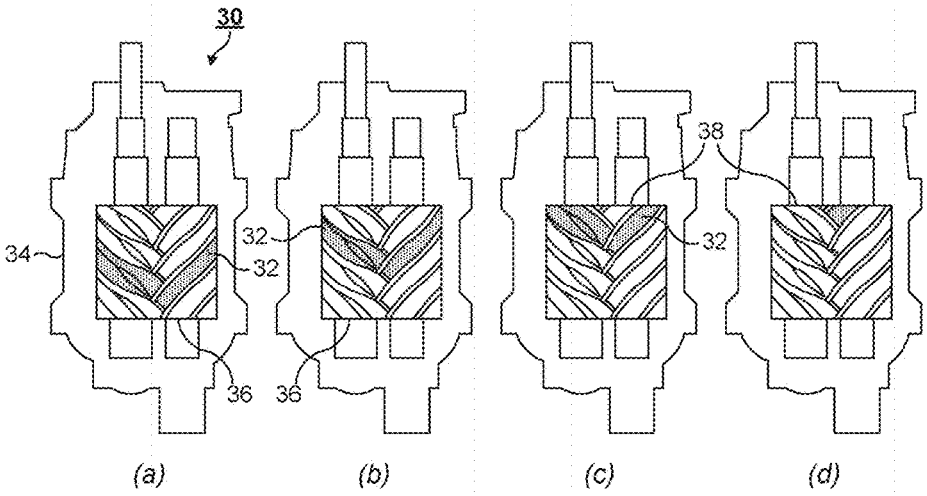
FIG. 3 (Prior Art)
FIGS. 3 (*a*) to (*d*), show an illustration of a twin-screw compressor and its operation.
Figure 4:
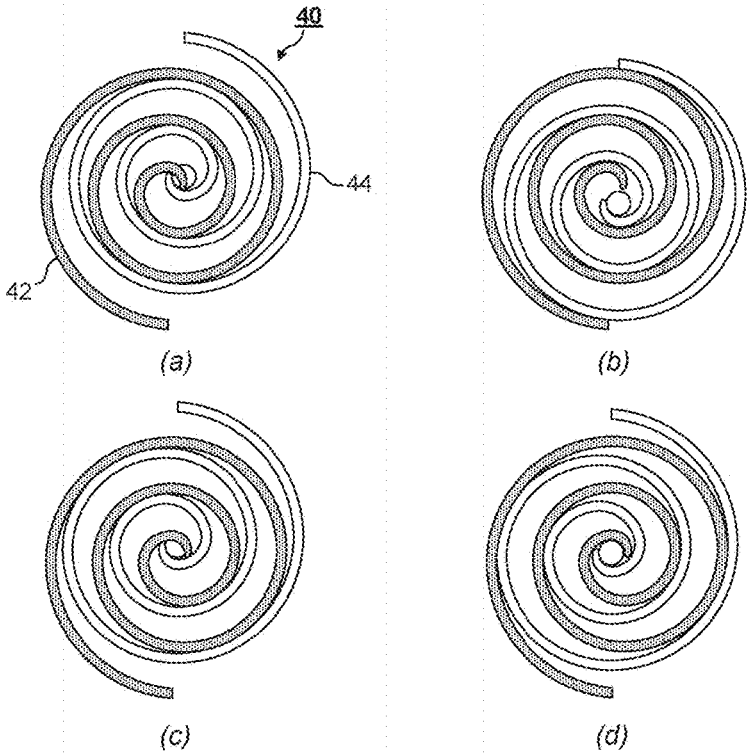
FIG. 4 (Prior Art)
FIG. 4 shows a schematic illustration of a scroll mechanism compressor and the principle of operation, where (a) shows the scroll mechanism at maximum filling position, (b) shows the scroll mechanism at the inlet cut-off, (c) shows the scroll mechanism, at the start of discharge and (d) shows the scroll mechanism at the end of the discharge.
Figure 5:
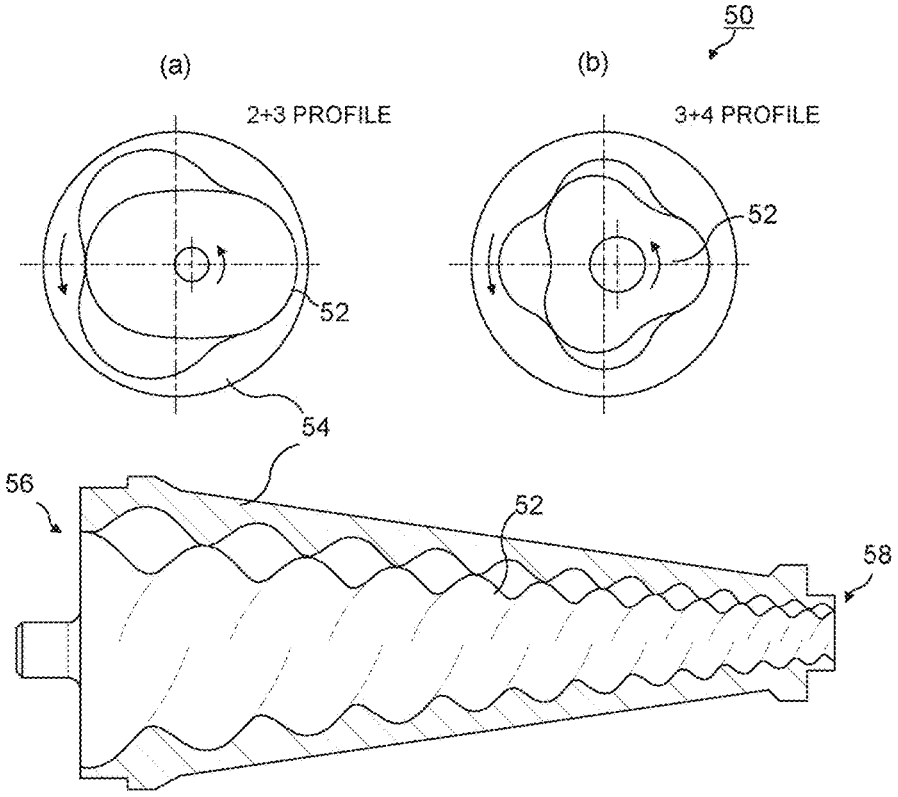
FIG. 5 (Prior Art)
FIG. 5 shows an example of a rotary conical screw compressor with two different geometries: (a) 2+3 profile, and (b) 3+4 profile.
Figure 6:
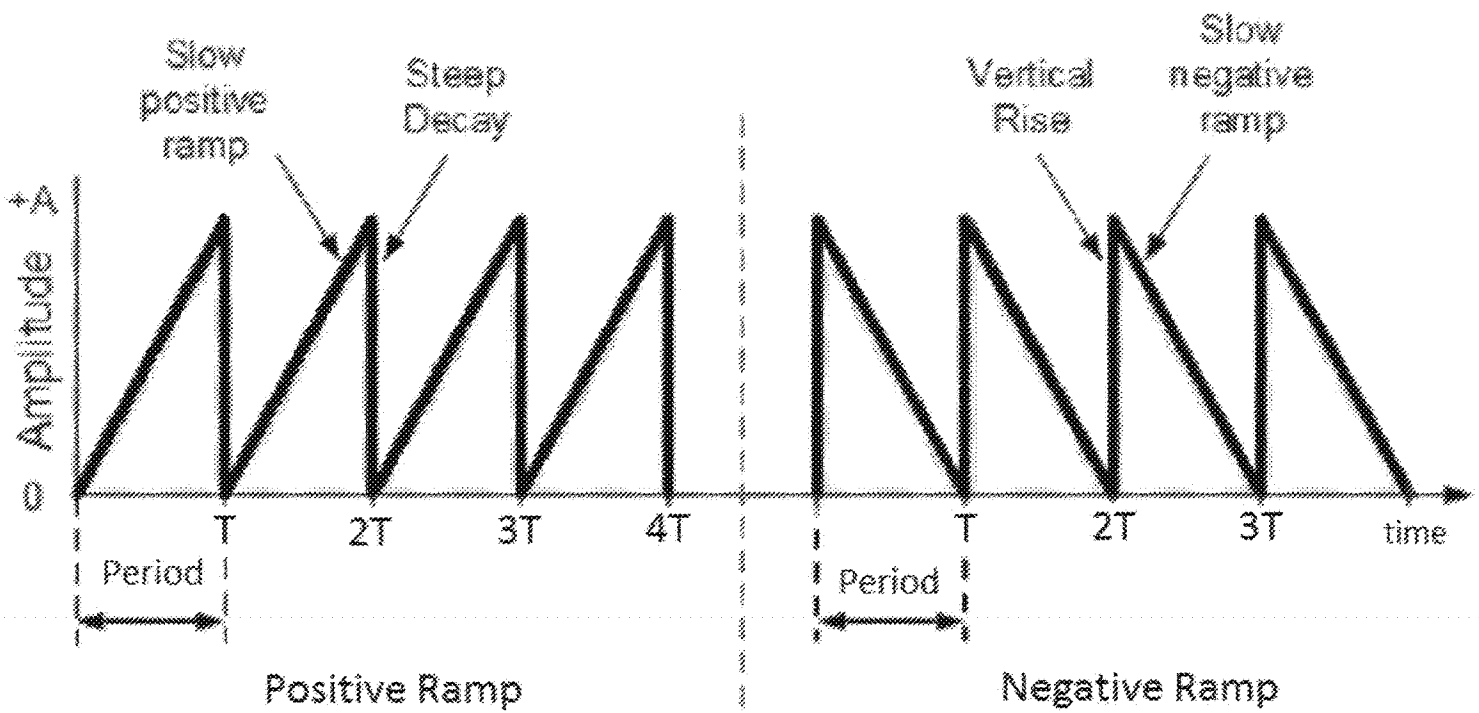
FIG. 6 (Prior Art)
FIG. 6 shows an illustration of a linear saw-tooth waveform describing the volume change during expansion (positive ramp) and compression (negative ramp)
Figure 7:
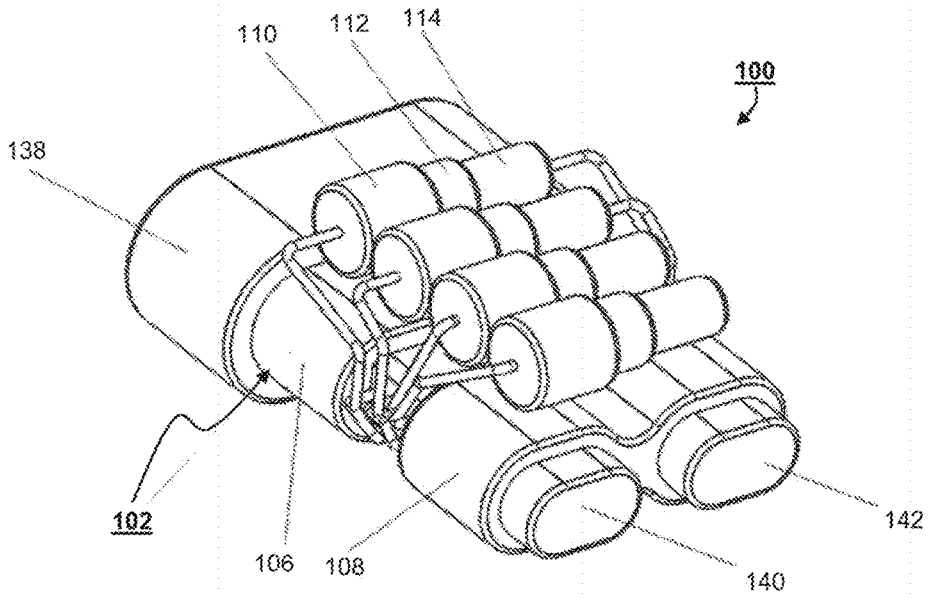
FIG. 7 shows an isometric view of an embodiment of the apparatus of the present invention (twin-screw Stirling cooler) (a) from the "expansion" or "cold" unit side and (b) from the "compression" or "warm" (or "hot") unit side.
Figure 7:
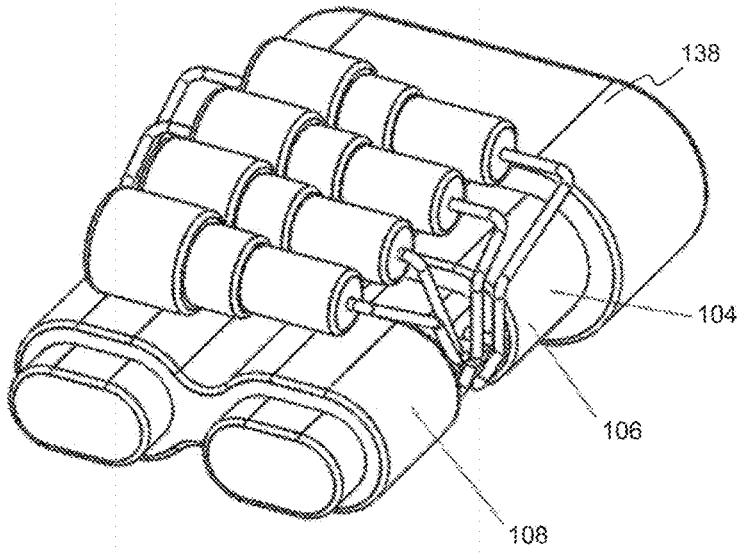
Figure 23:
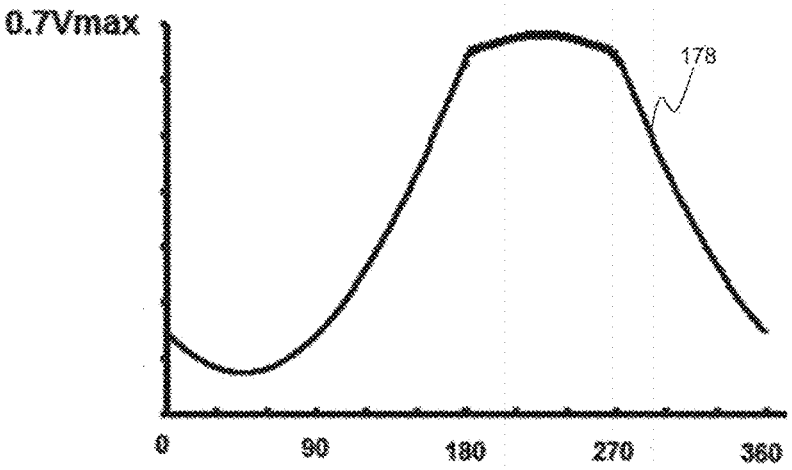
FIG. 23 shows a diagram of the sum of the paired volume variation in FIG. 21.
Figure 24:
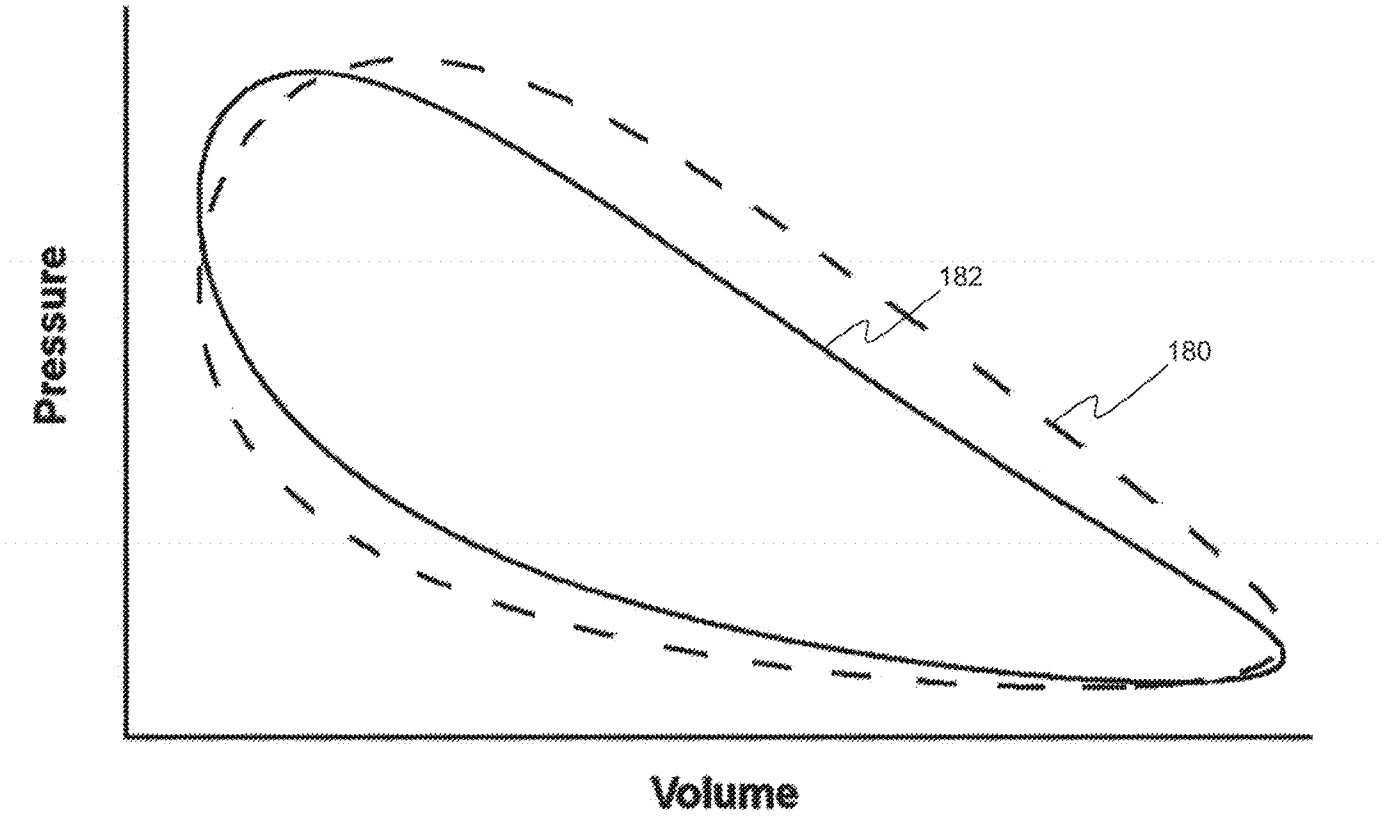
FIG. 24 shows a PV-diagram of the expansion (solid) and compression (dashed) space of the cooling Stirling cycle apparatus of the present invention.

FIG. 23 shows the sum 178 of the two paired working volumes 174, 176 for the two paired working spaces. It can be seen that the sum 178 of the two paired working volumes 174, 176 is very close to the variation of working spaces in a conventional Stirling engine (see FIG. 2(*a*)). Thus, when connecting the paired working spaces in the "cold" unit 102 with the paired working spaces in the "warm" unit 104 (via a set of heat exchangers 110, 114, and regenerator 112) a Stirling-cycle cooler apparatus 100 can be realised. Also, it can be understood that, because there are four working spaces in the "cold" unit 102 and four working spaces in the "warm" unit 104, the Stirling-cycle cooler will have the equivalent of four separate gas circuits, wherein each one of the four gas circuits has a pressure-volume diagram similar to that shown in FIG. 24, where the PV diagram for the compression space 180 is greater than the PV diagram for the expansion space 182 (i.e. cooling mode).

Figure 25:
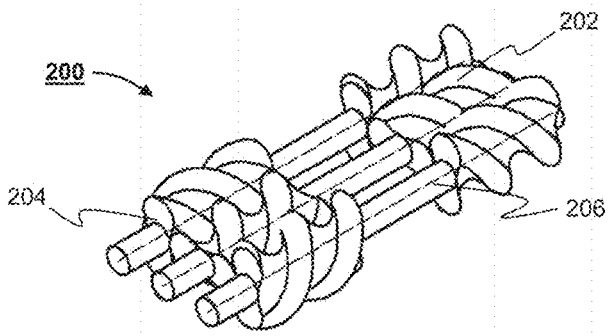
FIG. 25 shows an alternative multi-block configuration of a twin-screw mechanism for the Stirling-cycle apparatus of the present invention, with either a single common male or female rotor located in-between respective female or male rotors.
Figure 26:
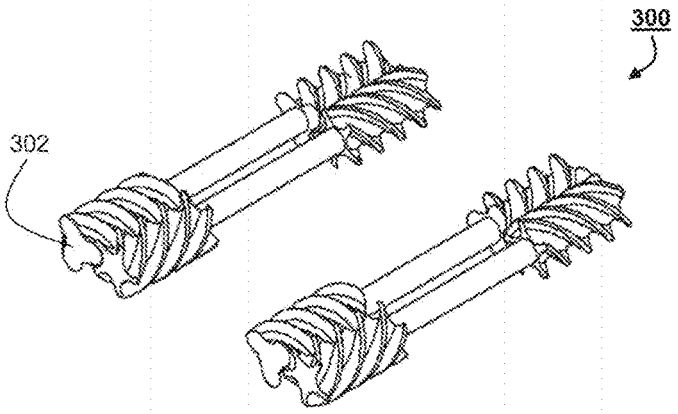
FIG. 26 shows an alternative set of twin-screw mechanisms utilising rotors with a three-lobe arrangement.
Figure 27:
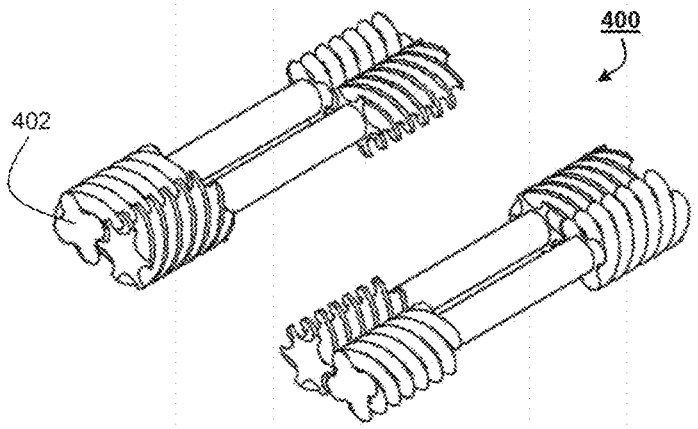
FIG. 27 shows another alternative set of twin-screw mechanisms utilising rotors with a four-lobe arrangement.

Alternative designs of the screw mechanism are shown in FIGS. 25, 26 and 27, all of which may be used instead of the two-lobed twin-screw mechanism 116, 118 described with the example embodiment of the present invention. It is understood by a person skilled in the art that alterations to corresponding internal and external fluid connections, conduit and fluid outlets for and between the "cold and hot" unit may be necessary without diverting from the characterising concept of the present invention. For example, a multi-block screw mechanism 200 is shown in FIG. 25, where a single common male or female rotor 202 is arranged in-between corresponding male and female rotors 204 or 206.

Furthermore, a range of different rotor lobe geometry configurations and profiles may be used for the Stirling-cycle apparatus of the present invention, for example, utilising screw rotors with more than two lobes, provided that the phase angle between compression and expansion working spaces is suitable to generate adequate cooling/heating performance or output of mechanical work. Also, rotors and lobes may be made of different diameters and/or lengths, e.g. the diameter of the twin-screw rotors either in the "cold" unit may be made greater than that in the "warm" unit, or vice-versa, in order to augment power, cold or heat generation at relatively low temperature differences between the heat source and the heat sink.

FIG. 26 shows an example of two twin-screw mechanisms 300 with three-lobe rotors 302, and FIG. 27 shows an example of two twin-screw mechanisms 400 with four-lobe rotors 402. It is understood that the middle section of the male shafts (rotating valve mechanism) may comprise (an) additional set(s) of corresponding conduits (e.g. one additional set of corresponding conduits per additional lobe), each of which splits the sum of paired chambers in the expansion part and compression part into corresponding two working spaces, so as to provide the required periodical volume variation with gas compression/expansion with the rotation of the shaft(s). It is also understood that additional sets of working spaces (e.g. from additional chambers formed by additional lobes) results in the formation of additional gas circuits.

Figure 28:
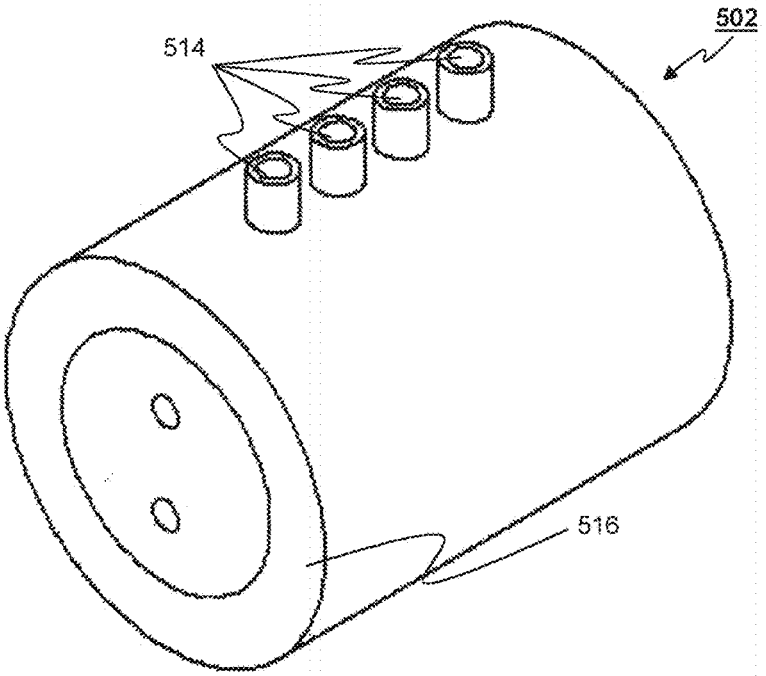
FIG. 28 shows an isometric view of an alternative embodiment of the rotating valve assembly, wherein the circumferential fluid channels are provided on the rotating drive shaft.
Figure 29:
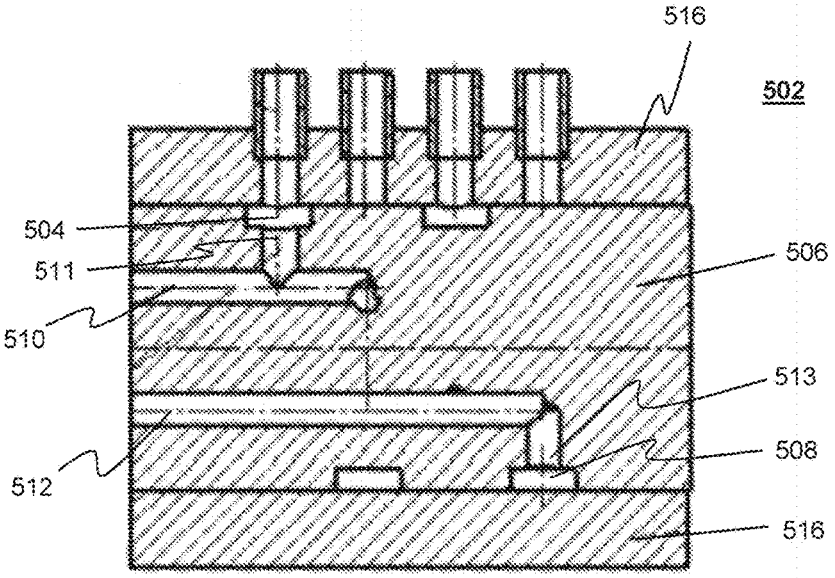
FIG. 29 shows a sectional view of the alternative embodiment of the rotating valve assembly in FIG. 28.
Figure 30:
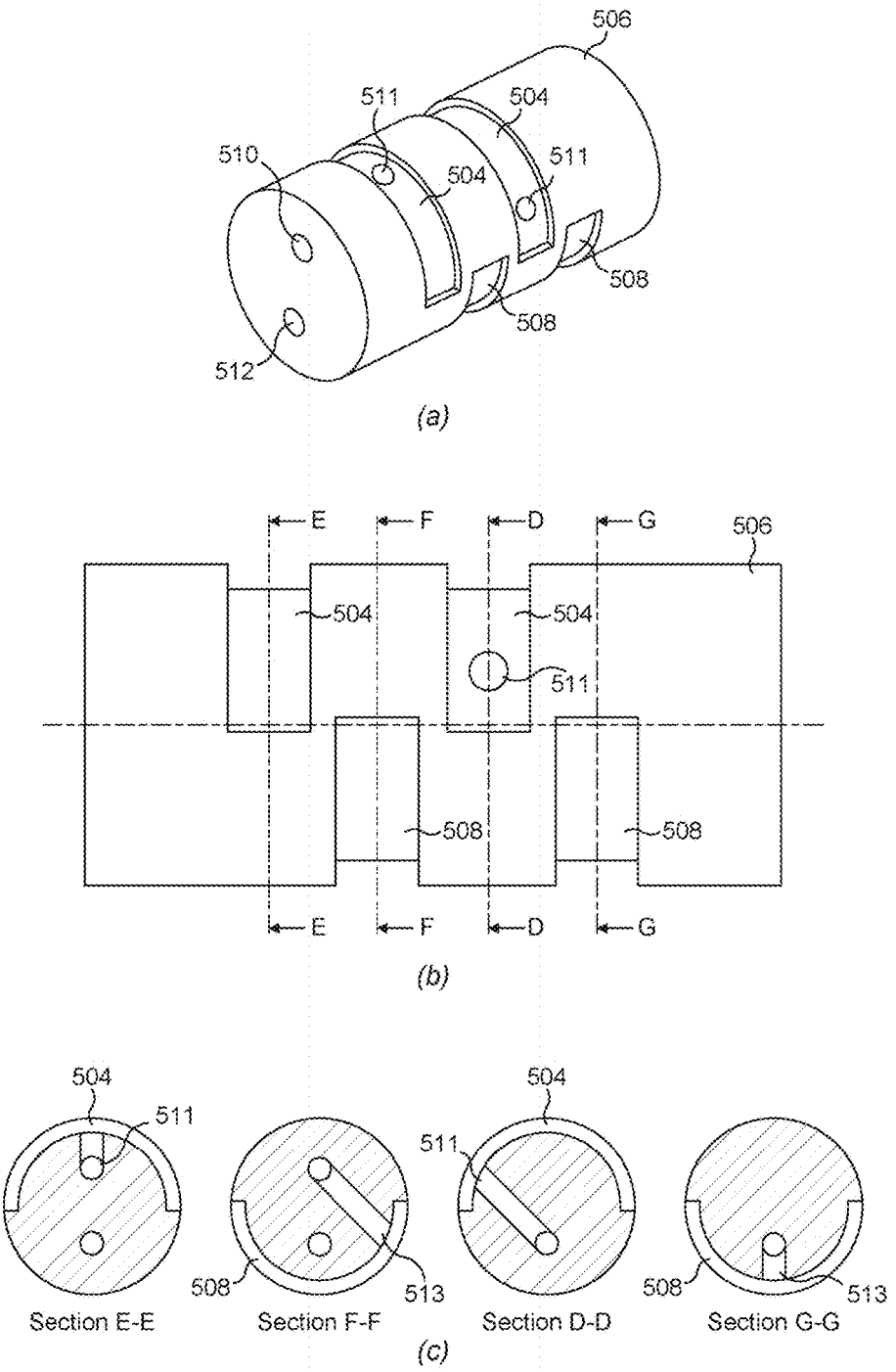
FIG. 30 shows (a) an isometric view, (b) a side view and (c) sectional views of a portion of the drive shaft exposing the circumferential fluid channels provided at the outer surface of the drive shaft and the interior conduits.

In another alternative embodiment of the present invention, the drive coupling assembly may comprise an alternative valve mechanism 502 as illustrated in FIGS. 28 to 30 (*a*), (*b*). In the alternative valve mechanism, a plurality of axially spaced and partially circumferential first fluid channels 504 is provided at respective predetermined first axial positions extending over a first circumferential segment of an outer surface of a drive shaft 506, and a plurality of axially-spaced and partially circumferential second fluid channels 508 is provided at respective predetermined second axial positions extending over a second circumferential segment of the outer surface of the drive shaft 506, wherein the first circumferential segment is provided radially opposite from the second circumferential segment, and wherein each one of the first axial positions is axially offset from each one of the second axial positions. In addition, a first fluid conduit 510 and a second fluid conduit 512 are provided in the drive shaft 506. Each fluid conduit 510, 512 comprises two fluidly conjoined outlet ports 511, 513, wherein a first outlet port 511 is fluidly coupled with one of the first fluid channels 504 and the second outlet port 513 is fluidly coupled with one of the second fluid channels 508. Fluid connections 514 are arranged in a casing 516 enclosing the drive shaft 506 and each one is adapted to temporarily form a fluid connection with one of the first or second fluid channels 504, 508 during rotation of the drive shaft 506.

Figure 31:
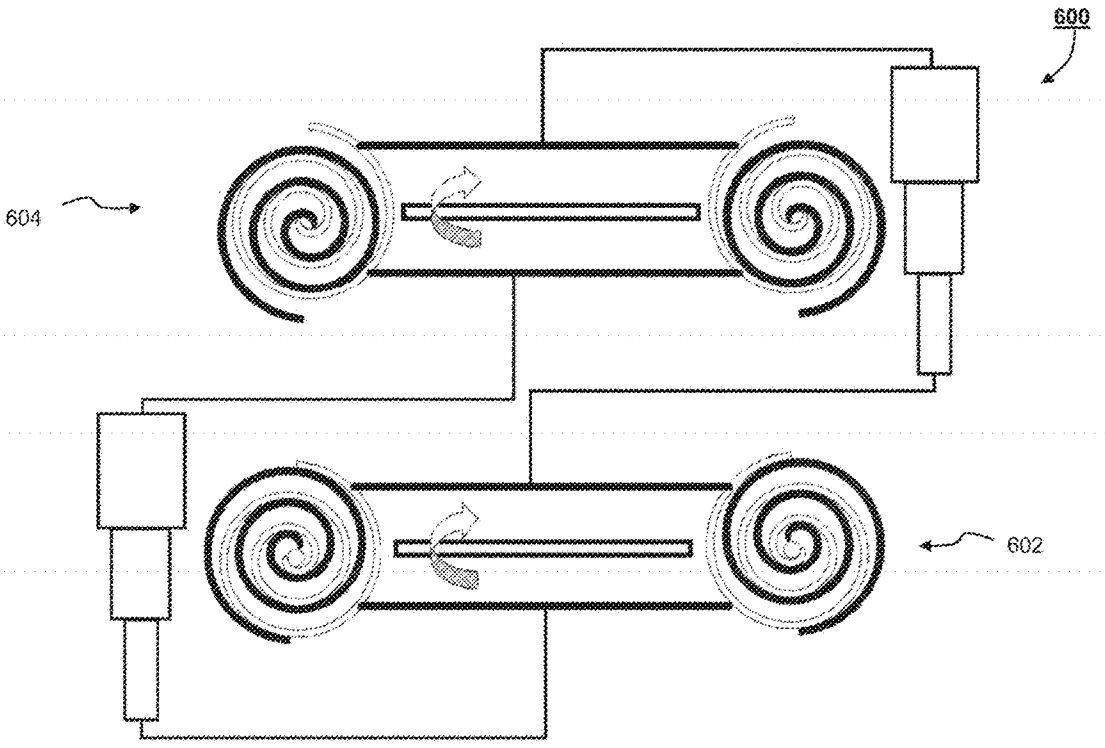
FIG. 31 shows a schematic illustration of an alternative embodiment of the apparatus of the present invention utilising corresponding scroll mechanisms, wherein the "cold" and "warm" units are fluidly coupled via a heat exchanger assembly (cold heat exchanger, regenerator, warm heat exchanger).

In another alternative embodiment 600 of the present invention is shown in FIG. 31, where scroll mechanisms 602, 604 are used instead of the twin-screw mechanism described previously. The operational principle is the same as described for the embodiment comprising twin-screw rotors, i.e. the shaft rotation in the "cold" unit 604 is synchronised with the shaft rotation in the "warm" unit 602 in such a way that there is an optimal phase angle between variations of working spaces in the "cold" unit 604 and variations of working spaces in the "warm" unit 602. The working process may be described by diagrams as shown in FIGS. 20 to 23, however, it is understood that the completion of a cycle may require two or more shaft revolutions.

In yet another alternative embodiment (not shown), different compression/expansion mechanisms (e.g. scroll and twin-screw) may be combined. However, it is understood that the variation of volumes (following a linear or nonlinear saw-tooth like function) is synchronised, so as to form a closed regenerative Stirling cycle.

Furthermore, connections of volumes in the embodiment, when utilising rotary conical screw mechanisms, may be similar to that with twin-screw rotors.

In addition, a multi-stage arrangement of the present invention (in cooling mode) may be used to achieve even lower temperatures as would be possible with the embodiment as described above. Furthermore, the Stirling-cycle machines of the present invention may be provided as a flat, box-type, cylindrical and other form. As mentioned previously, the heat exchangers or at least a portion of the heat-exchangers may be integrated into at least part of the casing or shaft of rotors, so as to minimise the size of the Stirling-cycle apparatus of the present invention. Alternatively, parts of the casing or shafts may be utilised as one of the heat exchangers.

It will be appreciated by persons skilled in the art that the above embodiment(s) have been described by way of example only and not in any limitative sense, and that various alterations and modifications are possible without departing from the scope of the invention as defined by the appended claims.

The invention claimed is:

1. A Stirling-cycle apparatus comprising:

a hermetically sealable housing;

a first rotary displacement unit in fluid communication with a second rotary fluid displacement unit, each of the first and second rotary displacement units operatively mounted in a separate, fluidly sealed portion within the housing and adapted to provide a cyclic change of at least one thermodynamic state parameter of a working fluid during use, each of the first and second rotary displacement units comprising:

a compressor mechanism, having a first compressor working chamber that is adapted to receive a first portion of the working fluid, and at least a second compressor working chamber that is adapted to receive a second portion of the working fluid, the first compressor working chamber comprises a first outlet port and the second compressor working chamber comprises a second outlet port;

an expander mechanism, having a first expander working chamber that is adapted to receive the first portion of the working fluid, and at least a second expander working chamber that is adapted to receive the second portion of the working fluid, the first expander working chamber comprises a first inlet port and the second expander working chamber comprises a second inlet port;

a drive coupling assembly, adapted to operatively couple the first expander mechanism to the first compressor mechanism, comprising:

a rotating valve mechanism, adapted to provide a predetermined sequence of a cyclic fluid exchange between the first compressor working chamber and the first expander working chamber, and between the second compressor working chamber and the second expander working chamber, at predetermined intervals of the angle of rotation of the first and second rotatory displacement unit;

an actuator, operatively coupled to the first and second rotary displacement unit, and adapted to synchronously link the rotational movement of the first rotary displacement unit with the second rotary displacement unit, such that the first predetermined cyclic change of at least one thermodynamic state parameter of the working fluid is offset in relation to the second predetermined cyclic change of at least one thermodynamic state parameter of the working fluid by a predetermined phase angle, during use.

2. The Stirling-cycle apparatus according to claim 1, wherein the first drive coupling assembly further comprises at least one first drive shaft and at least one first shaft casing having an inner wall and which is configured to operatively enclose the at least one first drive shaft.

3. The Stirling-cycle apparatus according to claim 2, wherein the at least one first shaft casing comprises a plurality of axially-spaced and partially circumferential first fluid channels provided at respective predetermined first axial positions extending over a first circumferential segment of the inner wall, and a plurality of axially-spaced and partially circumferential second fluid channels, provided at respective predetermined second axial positions extending over a second circumferential segment of the inner wall, and wherein the first circumferential segment is provided radially opposite the second circumferential segment, and wherein each one of the first axial positions is axially offset from each one of the second axial positions.

4. The Stirling-cycle apparatus according to claim 3, wherein each one of the plurality of axially-spaced and partially circumferential first and second fluid channels subtends an angle greater than 180 degrees.

5. The Stirling-cycle apparatus according to claim 2, wherein the at least one drive shaft comprises a first set of two corresponding conduits, a first conduit having a first opening fluidly coupled to the first outlet port and a second conduit having a first opening fluidly coupled to the first inlet port, each one of the corresponding first and second conduits has two conjoined axially adjacent second openings exiting radially out of the drive shaft at a first predetermined radial angle, wherein a first one of the two conjoined axially adjacent second openings is adapted to fluidly engage with one of the plurality of first fluid channels, and a second one of the two conjoined axially adjacent second openings is adapted to fluidly engage with one of the plurality of second fluid channels.

6. The Stirling-cycle apparatus according to claim 5, wherein the at least one drive shaft comprises at least a second set of two corresponding conduits, a first conduit having a first opening fluidly coupled to the second outlet port and a second conduit having a first opening fluidly coupled to the second inlet port, each one of the corresponding first and second conduits has two conjoined axially adjacent second openings exiting radially out of the drive shaft at a second predetermined radial angle, wherein a first one of the two conjoined axially adjacent second openings is adapted to fluidly engage with one of the plurality of first fluid channels, and a second one of the two conjoined axially adjacent second openings is adapted to fluidly engage with one of the plurality of second fluid channels.

7. The Stirling-cycle apparatus according to claim 6, wherein each one of the plurality of first fluid channels is fluidly coupled to a corresponding one of the plurality of second fluid channels, so as to allow a predetermined sequence of fluid exchange between the first compressor working chamber and the first expander working chamber, and between the second compressor working chamber and the second expander working chamber, during use.

8. The Stirling-cycle apparatus according to claim 7, wherein a first and second working space is formed for each one of the fluidly coupled the first compressor working chamber and the first expander working chamber, and the fluidly coupled the second compressor working chamber and the second expander working chamber, in the first rotary displacement unit.

9. The Stirling-cycle apparatus according to claim 7, wherein a first and second working space is formed for each one of the fluidly coupled the first compressor working chamber and the first expander working chamber, and the fluidly coupled the second compressor working chamber and the second expander working chamber, in the second rotary displacement unit.

10. The Stirling-cycle apparatus according to claim 9, wherein each one of the first and second working space of the first rotary displacement unit is in fluid communication with a corresponding one of the first and second working space of the second rotary displacement unit.

11. The Stirling-cycle apparatus according to claim 7, wherein each one of the corresponding fluidly coupled first and second fluid channels of the first rotary displacement unit is in fluid communication with a respective one of each one of the corresponding fluidly coupled first and second fluid channels of the second rotary displacement unit.

12. The Stirling-cycle apparatus according to claim 11, wherein each fluid communication between each one of the corresponding fluidly coupled first and second of fluid channels of the first rotary displacement unit and each one of the corresponding fluidly coupled first and second fluid channel of the second rotary displacement unit comprises any one or any serial combination of a first heat exchanger, a regenerator and a second heat exchanger.

13. The Stirling-cycle apparatus according to claim 12, wherein the first heat exchanger is adapted to provide heat to the working fluid, and wherein the second heat exchanger is adapted to remove heat from the working fluid.

14. The Stirling-cycle apparatus according to claim 12, wherein the regenerator is fluidly coupled between the first and second heat exchanger.

15. The Stirling-cycle apparatus according to claim 12, wherein the first heat exchanger is an integral part of the first rotary displacement unit and/or the second heat exchanger is an integral part of the second rotary displacement unit.

16. The Stirling-cycle apparatus according to claim 1, wherein each one of the first and second rotary displacement unit comprises a twin-screw mechanism.

17. The Stirling-cycle apparatus according to claim 1, wherein each one of the first and second rotary displacement units comprise a scroll mechanism or a rotary conical screw mechanism.

18. The Stirling-cycle apparatus according to claim 1, wherein each one of the first and second displacement unit comprises any one of a twin-screw mechanism, a scroll mechanism, or a rotary conical screw mechanism.

19. The Stirling-cycle apparatus according to claim 1, wherein the actuator comprises a motor and a transmission adapted to synchronously drive the first and second rotary displacement units.

20. The Stirling-cycle apparatus according to claim 1, wherein the actuator comprises a motor and a transmission adapted to be powered by any one of the first and second rotary displacement units.

21. The Stirling-cycle apparatus according to claim 1, wherein each one of the compressor and expander mechanism of the first rotary displacement unit, and each one of the compressor and expander mechanism of the second rotary displacement unit, is provided in a discrete and hermetically sealed portion of the housing.

22. The Stirling-cycle apparatus according to claim 1, wherein the first rotary displacement unit is a compression unit, and wherein the second rotary displacement unit is an expansion unit.

* * * * *